US007489784B2

(12) United States Patent
Yoshino

(10) Patent No.: US 7,489,784 B2
(45) Date of Patent: Feb. 10, 2009

(54) AUTOMATIC SOUND FIELD CORRECTING DEVICE AND COMPUTER PROGRAM THEREFOR

(75) Inventor: Hajime Yoshino, Saitama (JP)

(73) Assignee: Pioneer Corporation, Tokyo (JP)

( * ) Notice: Subject to any disclaimer, the term of this patent is extended or adjusted under 35 U.S.C. 154(b) by 964 days.

(21) Appl. No.: 10/991,535

(22) Filed: Nov. 19, 2004

(65) Prior Publication Data

US 2005/0135631 A1 Jun. 23, 2005

(30) Foreign Application Priority Data

Nov. 19, 2003 (JP) ..... 2003-389025

(51) Int. Cl.
*H04R 29/00* (2006.01)
*H04R 3/00* (2006.01)

(52) U.S. Cl. ..... 381/59; 381/96; 381/103

(58) Field of Classification Search ..... 381/17–19, 381/56–59, 61, 63, 95–96, 101–103
See application file for complete search history.

(56) References Cited

U.S. PATENT DOCUMENTS

| | | | | |
|---|---|---|---|---|
| 4,694,498 | A * | 9/1987 | Suzuki et al. | 381/103 |
| 5,572,443 | A * | 11/1996 | Emoto et al. | 702/103 |
| 5,581,621 | A * | 12/1996 | Koyama et al. | 381/103 |
| 6,901,148 | B2 * | 5/2005 | Yoshino et al. | 381/103 |
| 6,970,568 | B1 * | 11/2005 | Freeman et al. | 381/58 |
| 7,054,448 | B2 * | 5/2006 | Yoshino et al. | 381/59 |
| 7,058,187 | B2 * | 6/2006 | Ohta | 381/98 |
| 7,143,649 | B2 * | 12/2006 | Yoshino | 73/579 |
| 7,171,009 | B2 * | 1/2007 | Ohta | 381/98 |
| 7,249,511 | B2 * | 7/2007 | Higashihara | 73/579 |
| 2005/0031130 | A1 * | 2/2005 | Devantier et al. | 381/58 |

FOREIGN PATENT DOCUMENTS

| | | |
|---|---|---|
| EP | 0 308 009 | 3/1989 |
| EP | 1 253 805 | 10/2002 |
| JP | 2002-330499 | 11/2002 |

* cited by examiner

*Primary Examiner*—Xu Mei
(74) *Attorney, Agent, or Firm*—Young & Thompson

(57) ABSTRACT

An automatic sound field correcting device executes a signal process to the plurality of audio signals on respective correspondent signal transmission paths, and outputs them to a plurality of correspondent speakers to correct sound characteristics on the respective signal transmission paths. Namely, a measurement signal is supplied to each signal transmission path, and a measurement sound corresponding to it is outputted from the speaker to a sound space. The outputted measurement sound is detected as a detecting signal. The frequency characteristic of the audio signal on each signal transmission path is corrected by an equalizer, and a gain value of the equalizer is determined by a correction amount determining unit. A frequency characteristics correction is performed predetermined times. At a first correction, the correction amount determining unit determines the correction amount by performing a frequency analysis, based on the detecting signal, i.e. base on the detecting signal corresponding to the measurement sound actually outputted to the sound space. On the contrary, at and after a second correction, the correction amount determining unit determines the correction amount based on the detecting signal or an output signal of the equalizer. Namely, at and after the second correction, the output signal of the equalizer is supplied to the correction amount determining unit in a signal processing circuit as the need arises, and the frequency characteristics correction is performed without actually outputting the measurement sound to the sound space.

10 Claims, 22 Drawing Sheets

FIG. 2A

| | CORRECTING METHOD | SW151 | SW152 | SW153 |
|---|---|---|---|---|
| 1st TIME | VIA SOUND SPACE | T1 SIDE | OFF | ON |
| AT AND AFTER 2nd TIME | IN PROCESSOR | T2 SIDE | ON | OFF |

FIG. 2B

| | CORRECTING METHOD | SW151 | SW152 | SW153 |
|---|---|---|---|---|
| 1st TIME | VIA SOUND SPACE | T1 SIDE | OFF | ON |
| AT AND AFTER 2nd TIME | IN PROCESSOR | T2 SIDE | ON | OFF |
| LAST TIME | VIA SOUND SPACE | T1 SIDE | OFF | ON |

FIG. 2C

| | CORRECTING METHOD | SW151 | SW152 | SW153 |
|---|---|---|---|---|
| 1st TIME | VIA SOUND SPACE | T1 SIDE | OFF | ON |
| AT AND AFTER 2nd TIME | IN PROCESSOR (*) | T2 SIDE | ON | OFF (OR ON) |

(*) OUTPUT MEASUREMENT SOUND

FIG. 15

<REPRODUCTION (OUTPUT) ORDER PATTERN>

| | BLOCK PERIOD | | | | | | | | | | | | | | | |
|---|---|---|---|---|---|---|---|---|---|---|---|---|---|---|---|---|
| NUMBER | T0 | T1 | T2 | T3 | T4 | T5 | T6 | T7 | T8 | T9 | T10 | T11 | T12 | T13 | T14 | T15 |
| 1st | pn0 | pn1 | pn2 | pn3 | pn4 | pn5 | pn6 | pn7 | pn8 | pn9 | pn10 | pn11 | pn12 | pn13 | pn14 | pn15 |
| 2nd | pn1 | pn2 | pn3 | pn4 | pn5 | pn6 | pn7 | pn8 | pn9 | pn10 | pn11 | pn12 | pn13 | pn14 | pn15 | pn0 |
| 3rd | pn2 | pn3 | pn4 | pn5 | pn6 | pn7 | pn8 | pn9 | pn10 | pn11 | pn12 | pn13 | pn14 | pn15 | pn0 | pn1 |
| 4th | pn3 | pn4 | pn5 | pn6 | pn7 | pn8 | pn9 | pn10 | pn11 | pn12 | pn13 | pn14 | pn15 | pn0 | pn1 | pn2 |
| 5th | pn4 | pn5 | pn6 | pn7 | pn8 | pn9 | pn10 | pn11 | pn12 | pn13 | pn14 | pn15 | pn0 | pn1 | pn2 | pn3 |
| 6th | pn5 | pn6 | pn7 | pn8 | pn9 | pn10 | pn11 | pn12 | pn13 | pn14 | pn15 | pn0 | pn1 | pn2 | pn3 | pn4 |
| 7th | pn6 | pn7 | pn8 | pn9 | pn10 | pn11 | pn12 | pn13 | pn14 | pn15 | pn0 | pn1 | pn2 | pn3 | pn4 | pn5 |
| 8th | pn7 | pn8 | pn9 | pn10 | pn11 | pn12 | pn13 | pn14 | pn15 | pn0 | pn1 | pn2 | pn3 | pn4 | pn5 | pn6 |
| 9th | pn8 | pn9 | pn10 | pn11 | pn12 | pn13 | pn14 | pn15 | pn0 | pn1 | pn2 | pn3 | pn4 | pn5 | pn6 | pn7 |
| 10th | pn9 | pn10 | pn11 | pn12 | pn13 | pn14 | pn15 | pn0 | pn1 | pn2 | pn3 | pn4 | pn5 | pn6 | pn7 | pn8 |
| 11th | pn10 | pn11 | pn12 | pn13 | pn14 | pn15 | pn0 | pn1 | pn2 | pn3 | pn4 | pn5 | pn6 | pn7 | pn8 | pn9 |
| 12th | pn11 | pn12 | pn13 | pn14 | pn15 | pn0 | pn1 | pn2 | pn3 | pn4 | pn5 | pn6 | pn7 | pn8 | pn9 | pn10 |
| 13th | pn12 | pn13 | pn14 | pn15 | pn0 | pn1 | pn2 | pn3 | pn4 | pn5 | pn6 | pn7 | pn8 | pn9 | pn10 | pn11 |
| 14th | pn13 | pn14 | pn15 | pn0 | pn1 | pn2 | pn3 | pn4 | pn5 | pn6 | pn7 | pn8 | pn9 | pn10 | pn11 | pn12 |
| 15th | pn14 | pn15 | pn0 | pn1 | pn2 | pn3 | pn4 | pn5 | pn6 | pn7 | pn8 | pn9 | pn10 | pn11 | pn12 | pn13 |
| 16th | pn15 | pn0 | pn1 | pn2 | pn3 | pn4 | pn5 | pn6 | pn7 | pn8 | pn9 | pn10 | pn11 | pn12 | pn13 | pn14 |

FIG. 16

<SOUND POWER DATA>

| | BLOCK PERIOD | | | | | | | | | | | | | | | |
|---|---|---|---|---|---|---|---|---|---|---|---|---|---|---|---|---|
| NUMBER | T0 | T1 | T2 | T3 | T4 | T5 | T6 | T7 | T8 | T9 | T10 | T11 | T12 | T13 | T14 | T15 |
| 1st | md0 | md1 | md2 | md3 | md4 | md5 | md6 | md7 | md8 | md9 | md10 | md11 | md12 | md13 | md14 | md15 |
| 2nd | md1 | md2 | md3 | md4 | md5 | md6 | md7 | md8 | md9 | md10 | md11 | md12 | md13 | md14 | md15 | md0 |
| 3rd | md2 | md3 | md4 | md5 | md6 | md7 | md8 | md9 | md10 | md11 | md12 | md13 | md14 | md15 | md0 | md1 |
| 4th | md3 | md4 | md5 | md6 | md7 | md8 | md9 | md10 | md11 | md12 | md13 | md14 | md15 | md0 | md1 | md2 |
| 5th | md4 | md5 | md6 | md7 | md8 | md9 | md10 | md11 | md12 | md13 | md14 | md15 | md0 | md1 | md2 | md3 |
| 6th | md5 | md6 | md7 | md8 | md9 | md10 | md11 | md12 | md13 | md14 | md15 | md0 | md1 | md2 | md3 | md4 |
| 7th | md6 | md7 | md8 | md9 | md10 | md11 | md12 | md13 | md14 | md15 | md0 | md1 | md2 | md3 | md4 | md5 |
| 8th | md7 | md8 | md9 | md10 | md11 | md12 | md13 | md14 | md15 | md0 | md1 | md2 | md3 | md4 | md5 | md6 |
| 9th | md8 | md9 | md10 | md11 | md12 | md13 | md14 | md15 | md0 | md1 | md2 | md3 | md4 | md5 | md6 | md7 |
| 10th | md9 | md10 | md11 | md12 | md13 | md14 | md15 | md0 | md1 | md2 | md3 | md4 | md5 | md6 | md7 | md8 |
| 11th | md10 | md11 | md12 | md13 | md14 | md15 | md0 | md1 | md2 | md3 | md4 | md5 | md6 | md7 | md8 | md9 |
| 12th | md11 | md12 | md13 | md14 | md15 | md0 | md1 | md2 | md3 | md4 | md5 | md6 | md7 | md8 | md9 | md10 |
| 13th | md12 | md13 | md14 | md15 | md0 | md1 | md2 | md3 | md4 | md5 | md6 | md7 | md8 | md9 | md10 | md11 |
| 14th | md13 | md14 | md15 | md0 | md1 | md2 | md3 | md4 | md5 | md6 | md7 | md8 | md9 | md10 | md11 | md12 |
| 15th | md14 | md15 | md0 | md1 | md2 | md3 | md4 | md5 | md6 | md7 | md8 | md9 | md10 | md11 | md12 | md13 |
| 16th | md15 | md0 | md1 | md2 | md3 | md4 | md5 | md6 | md7 | md8 | md9 | md10 | md11 | md12 | md13 | md14 |
| TOTAL POWER | rv0 | rv1 | rv2 | rv3 | rv4 | rv5 | rv6 | rv7 | rv8 | rv9 | rv10 | rv11 | rv12 | rv13 | rv14 | rv15 |

FIG. 18

<REPRODUCTION (OUTPUT) ORDER PATTERN>

| | BLOCK PERIOD | | | | | | | | | | | | | | | | | | | |
|---|---|---|---|---|---|---|---|---|---|---|---|---|---|---|---|---|---|---|---|---|
| NUMBER | T0 | T1 | T2 | T3 | T4 | T5 | T6 | T7 | T8 | T9 | T10 | T11 | T12 | T13 | T14 | T15 | T16 | T17 | ····· | T31 |
| 1st | pn0 | pn1 | pn2 | pn3 | pn4 | pn5 | pn6 | pn7 | pn8 | pn9 | pn10 | pn11 | pn12 | pn13 | pn14 | pn15 | pn0 | pn1 | ····· | pn15 |
| 2nd | pn1 | pn2 | pn3 | pn4 | pn5 | pn6 | pn7 | pn8 | pn9 | pn10 | pn11 | pn12 | pn13 | pn14 | pn15 | pn0 | pn1 | pn2 | ····· | pn0 |
| 3rd | pn2 | pn3 | pn4 | pn5 | pn6 | pn7 | pn8 | pn9 | pn10 | pn11 | pn12 | pn13 | pn14 | pn15 | pn0 | pn1 | pn2 | pn3 | ····· | pn1 |
| 4th | pn3 | pn4 | pn5 | pn6 | pn7 | pn8 | pn9 | pn10 | pn11 | pn12 | pn13 | pn14 | pn15 | pn0 | pn1 | pn2 | pn3 | pn4 | ····· | pn2 |
| 5th | pn4 | pn5 | pn6 | pn7 | pn8 | pn9 | pn10 | pn11 | pn12 | pn13 | pn14 | pn15 | pn0 | pn1 | pn2 | pn3 | pn4 | pn5 | ····· | pn3 |
| 6th | pn5 | pn6 | pn7 | pn8 | pn9 | pn10 | pn11 | pn12 | pn13 | pn14 | pn15 | pn0 | pn1 | pn2 | pn3 | pn4 | pn5 | pn6 | ····· | pn4 |
| 7th | pn6 | pn7 | pn8 | pn9 | pn10 | pn11 | pn12 | pn13 | pn14 | pn15 | pn0 | pn1 | pn2 | pn3 | pn4 | pn5 | pn6 | pn7 | ····· | pn5 |
| 8th | pn7 | pn8 | pn9 | pn10 | pn11 | pn12 | pn13 | pn14 | pn15 | pn0 | pn1 | pn2 | pn3 | pn4 | pn5 | pn6 | pn7 | pn8 | ····· | pn6 |
| 9th | pn8 | pn9 | pn10 | pn11 | pn12 | pn13 | pn14 | pn15 | pn0 | pn1 | pn2 | pn3 | pn4 | pn5 | pn6 | pn7 | pn8 | pn9 | ····· | pn7 |
| 10th | pn9 | pn10 | pn11 | pn12 | pn13 | pn14 | pn15 | pn0 | pn1 | pn2 | pn3 | pn4 | pn5 | pn6 | pn7 | pn8 | pn9 | pn10 | ····· | pn8 |
| 11th | pn10 | pn11 | pn12 | pn13 | pn14 | pn15 | pn0 | pn1 | pn2 | pn3 | pn4 | pn5 | pn6 | pn7 | pn8 | pn9 | pn10 | pn11 | ····· | pn9 |
| 12th | pn11 | pn12 | pn13 | pn14 | pn15 | pn0 | pn1 | pn2 | pn3 | pn4 | pn5 | pn6 | pn7 | pn8 | pn9 | pn10 | pn11 | pn12 | ····· | pn10 |
| 13th | pn12 | pn13 | pn14 | pn15 | pn0 | pn1 | pn2 | pn3 | pn4 | pn5 | pn6 | pn7 | pn8 | pn9 | pn10 | pn11 | pn12 | pn13 | ····· | pn11 |
| 14th | pn13 | pn14 | pn15 | pn0 | pn1 | pn2 | pn3 | pn4 | pn5 | pn6 | pn7 | pn8 | pn9 | pn10 | pn11 | pn12 | pn13 | pn14 | ····· | pn12 |
| 15th | pn14 | pn15 | pn0 | pn1 | pn2 | pn3 | pn4 | pn5 | pn6 | pn7 | pn8 | pn9 | pn10 | pn11 | pn12 | pn13 | pn14 | pn15 | ····· | pn13 |
| 16th | pn15 | pn0 | pn1 | pn2 | pn3 | pn4 | pn5 | pn6 | pn7 | pn8 | pn9 | pn10 | pn11 | pn12 | pn13 | pn14 | pn15 | pn0 | ····· | pn14 |

FIRST CYCLE

SECOND CYCLE

FIG. 19

<SOUND POWER DATA>

| | BLOCK PERIOD | | | | | | | | | | | | | | | | | | | |
|---|---|---|---|---|---|---|---|---|---|---|---|---|---|---|---|---|---|---|---|---|
| NUMBER | T0 | T1 | T2 | T3 | T4 | T5 | T6 | T7 | T8 | T9 | T10 | T11 | T12 | T13 | T14 | T15 | T16 | T17 | ····· | T31 |
| 1st | md0 | md1 | md2 | md3 | md4 | md5 | md6 | md7 | md8 | md9 | md10 | md11 | md12 | md13 | md14 | md15 | md0 | md1 | ····· | md15 |
| 2nd | md1 | md2 | md3 | md4 | md5 | md6 | md7 | md8 | md9 | md10 | md11 | md12 | md13 | md14 | md15 | md0 | md1 | md2 | ····· | md0 |
| 3rd | md2 | md3 | md4 | md5 | md6 | md7 | md8 | md9 | md10 | md11 | md12 | md13 | md14 | md15 | md0 | md1 | md2 | md3 | ····· | md1 |
| 4th | md3 | md4 | md5 | md6 | md7 | md8 | md9 | md10 | md11 | md12 | md13 | md14 | md15 | md0 | md1 | md2 | md3 | md4 | ····· | md2 |
| 5th | md4 | md5 | md6 | md7 | md8 | md9 | md10 | md11 | md12 | md13 | md14 | md15 | md0 | md1 | md2 | md3 | md4 | md5 | ····· | md3 |
| 6th | md5 | md6 | md7 | md8 | md9 | md10 | md11 | md12 | md13 | md14 | md15 | md0 | md1 | md2 | md3 | md4 | md5 | md6 | ····· | md4 |
| 7th | md6 | md7 | md8 | md9 | md10 | md11 | md12 | md13 | md14 | md15 | md0 | md1 | md2 | md3 | md4 | md5 | md6 | md7 | ····· | md5 |
| 8th | md7 | md8 | md9 | md10 | md11 | md12 | md13 | md14 | md15 | md0 | md1 | md2 | md3 | md4 | md5 | md6 | md7 | md8 | ····· | md6 |
| 9th | md8 | md9 | md10 | md11 | md12 | md13 | md14 | md15 | md0 | md1 | md2 | md3 | md4 | md5 | md6 | md7 | md8 | md9 | ····· | md7 |
| 10th | md9 | md10 | md11 | md12 | md13 | md14 | md15 | md0 | md1 | md2 | md3 | md4 | md5 | md6 | md7 | md8 | md9 | md10 | ····· | md8 |
| 11th | md10 | md11 | md12 | md13 | md14 | md15 | md0 | md1 | md2 | md3 | md4 | md5 | md6 | md7 | md8 | md9 | md10 | md11 | ····· | md9 |
| 12th | md11 | md12 | md13 | md14 | md15 | md0 | md1 | md2 | md3 | md4 | md5 | md6 | md7 | md8 | md9 | md10 | md11 | md12 | ····· | md10 |
| 13th | md12 | md13 | md14 | md15 | md0 | md1 | md2 | md3 | md4 | md5 | md6 | md7 | md8 | md9 | md10 | md11 | md12 | md13 | ····· | md11 |
| 14th | md13 | md14 | md15 | md0 | md1 | md2 | md3 | md4 | md5 | md6 | md7 | md8 | md9 | md10 | md11 | md12 | md13 | md14 | ····· | md12 |
| 15th | md14 | md15 | md0 | md1 | md2 | md3 | md4 | md5 | md6 | md7 | md8 | md9 | md10 | md11 | md12 | md13 | md14 | md15 | ····· | md13 |
| 16th | md15 | md0 | md1 | md2 | md3 | md4 | md5 | md6 | md7 | md8 | md9 | md10 | md11 | md12 | md13 | md14 | md15 | md0 | ····· | md14 |
| TOTAL POWER | rv0 | rv1 | rv2 | rv3 | rv4 | rv5 | rv6 | rv7 | rv8 | rv9 | rv10 | rv11 | rv12 | rv13 | rv14 | rv15 | rv16 | rv17 | ····· | rv31 |

FIRST CYCLE

SECOND CYCLE

AUTOMATIC SOUND FIELD CORRECTING DEVICE AND COMPUTER PROGRAM THEREFOR

BACKGROUND OF THE INVENTION

1. Field of the Invention

The present invention relates to an automatic sound field correcting device which automatically corrects a sound characteristic in an audio system having a plurality of speakers.

2. Description of Related Art

For an audio system having a plurality of speakers to provide a high quality sound space, it is required to automatically create an appropriate sound space with much presence. In other words, it is required for the audio system to automatically correct sound field characteristics because it is quite difficult for a listener to appropriately adjust the phase characteristic, the frequency characteristic, the sound pressure level and the like of sound reproduced by a plurality of speakers by manually manipulating the audio system by himself to obtain appropriate sound space.

So far, as this kind of automatic sound field correcting system, there is known a system disclosed in Japanese Patent Application Laid-open under No. 2002-330499. In this system, for each signal transmission path corresponding to plural channels, a test signal outputted from a speaker is collected, and a frequency characteristic thereof is analyzed. Then, by setting coefficients of an equalizer provided on the signal transmission path, each signal transmission path is corrected to have a desired frequency characteristic.

In a normal automatic sound field correcting system, the above-mentioned frequency characteristics correction is performed a plurality of times. Namely, a measurement sound is outputted from a speaker once, and a test signal is collected by a microphone. Then, an equalizer coefficient is set once. After setting of the equalizer coefficient, i.e., after the first correction, the test signal is outputted from the speaker again, and the test signal is collected by the microphone. The frequency characteristics correction is repeated plural times. Thereby, an error due to interference of the equalizer between frequency bands of a plurality of signal transmission paths, and a difference of characteristics between a frequency analyzing filter and an equalizer are absorbed. Concretely, the above-mentioned frequency characteristics correction process is repeated four to six times, and the final equalizer coefficient is determined.

However, as described above, since the operation of outputting the test signal from the speaker and collecting the outputted sound by the microphone is executed in each of a plurality of frequency characteristics correction processes, a time necessary for the frequency characteristics correction problematically becomes longer. The reasons are as follows. First, the test signal is outputted plural times at one frequency characteristics correction and the sound is collected by the microphone to execute averaging. Second, a predetermined interval is ensured after outputting of the test signal until the next output of the test signal in order to eliminate the effect of a reverberation. Third, it is necessary to perform a D/A conversion of the test signal and an A/D conversion of the collected test sound with a proper sampling frequency in order to properly output the test signal to the sound space as a test sound.

SUMMARY OF THE INVENTION

The present invention has been achieved in order to solve the above problems. It is an object of this invention to provide an automatic sound field correcting device capable of rapidly performing frequency characteristics correction plural times.

According to one aspect of the present invention, there is provided an automatic sound field correcting device which executes a signal processing of an audio signal on a correspondent signal transmission path to output a processed audio signal to a correspondent speaker, including: a frequency characteristic correcting unit which corrects a frequency characteristic of an audio signal on the signal transmission path; a measurement signal supplying unit which supplies a measurement signal to the signal transmission path; a measurement sound output unit which outputs a measurement sound corresponding to the measurement signal from the speaker to a sound space; a detecting unit which outputs the measurement signal sound outputted from the speaker as a detecting signal; and a correction amount determining unit which determines a correction amount used for a correction of the frequency characteristic by the frequency characteristic correcting unit and supplies the correction amount to the frequency characteristic correcting unit, wherein the correction amount determining unit determines the correction amount based on the detecting signal at a first correction of the frequency characteristic, and determines the correction amount based on the detecting signal or an output signal of the frequency characteristic correcting unit at and after a second correction of the frequency characteristic.

The above-mentioned automatic sound field correcting device executes the signal processing of the audio signal on the correspondent signal transmission path to output it to a correspondent speaker. Thereby, the sound characteristic on the signal transmission path is corrected. Namely, the measurement signal is supplied to the signal transmission path, and the measurement sound corresponding to it is outputted from the speaker to the sound space. The outputted measurement sound is detected as the detecting signal. The frequency characteristic of the audio signal on each signal transmission path is corrected by the frequency characteristic correcting unit, and a gain value of the frequency characteristic correcting unit is determined by the correction amount determining unit.

The frequency characteristic correction is performed a predetermined number of times. The correction amount determining unit determines the correction amount by performing a frequency analysis on the basis of the detecting signal, i.e., on the basis of the detecting signal corresponding to the measurement sound actually outputted to the sound space. On the contrary, the correction amount determining unit determines the correction amount based on the detecting signal or the output signal of the frequency characteristic correcting unit at and after the second correction. Namely, at and after the second correction, by supplying the output signal of the frequency characteristic correcting unit to the correction amount determining unit in the signal processing circuit if necessary, the correction amount determining unit performs the frequency characteristic correction without actually outputting the measurement sound to the sound space.

In an embodiment, the correction amount determining unit may determine the correction amount based on the output signal of the frequency characteristic correcting unit at and after the second correction. In another embodiment, the correction amount determining unit may determine the correction amount based on the detecting signal at least once at and after the second correction. In addition, the correction amount determining unit may determine the correction amount based on the detecting signal at least at the last correction of the second and subsequent corrections. Thereby, the processing time can be shortened, and correction accuracy can be ensured. Therefore, the entire time necessary for a plurality of frequency characteristic corrections can be shortened.

In one manner of the above automatic sound field correcting device, the detecting unit may output no detecting signal at the correction at which the correction amount determining unit determines the correction amount based on the output signal of the frequency characteristic correcting unit. Namely, when the frequency characteristic correction in the processor is performed, it becomes unnecessary to detect the measurement sound by the microphone.

In another manner, the measurement sound output unit may output no measurement sound at the correction at which the correction amount determining unit determines the correction amount based on the output signal of the frequency characteristic correcting unit. Thereby, the processing time due to averaging and a necessity of an output interval of the measurement sound can be shortened, and the time necessary for the correction can remarkably be shortened. However, the measurement sound output unit may output the measurement sound at all the corrections of the frequency characteristics.

In still another manner of the above automatic sound field correcting device, the measurement sound output unit may include: a block sound data generating unit which divides the measurement signal of a predetermined time period into a plurality of block periods and generates a plurality of block sound data; and a reproduction processing unit which outputs the measurement sound by executing a reproducing process of reproducing the plurality of block sound data in accordance with an order of forming the measurement signal for a reproduction order pattern identical to the measurement sound data and for all reproduction order patterns obtained by shifting the block sound data reproduced first one by one, wherein the correction amount determining unit operates the detecting signal corresponding to the block sound data reproduced in an identical reproduction order during each reproducing process and determines the frequency characteristic to determine the correction amount based on the frequency characteristic, and wherein the reproduction processing unit executes the reproducing process for only the reproduction order pattern identical to the measurement data at the correction at which the correction amount determining unit determines the correction amount based on the output signal of the frequency characteristics correcting unit.

In this manner, the shift operation which shifts the plurality of the block sound data forming the measurement signal prepared in advance and outputs them is adopted. In the automatic sound field correcting device of a type of measuring the frequency characteristic of the short time width, at and after the second correction, i.e., when the frequency characteristics correction in the processor is performed, the shift operation is not performed. Thereby, the necessary processing time is shortened.

According to another aspect of the present invention, there is provided a computer program which makes a computer function as an automatic sound field correcting device which executes a signal processing of an audio signals on a correspondent signal transmission path to output a processed audio signal to the correspondent speaker, the automatic sound field correcting device including: a frequency characteristic correcting unit which corrects a frequency characteristic of the audio signal on the signal transmission path; a measurement signal supplying unit which supplies a measurement signal to the signal transmission path; a measurement sound output unit which outputs a measurement sound corresponding to the measurement signal from the speaker to a sound space; a detecting unit which outputs the measurement signal sound outputted from the speaker as a detecting signal; and a correction amount determining unit which determines the correction amount used for a correction of the frequency characteristic by the frequency characteristic correcting unit and supplies the correction amount to the frequency characteristic correcting unit, wherein the correction amount determining unit determines the correction amount based on the detecting signal at a first correction of the frequency characteristic, and determines the correction amount based on the detecting signal or an output signal of the frequency characteristic correcting unit at and after a second correction of the frequency characteristic. By executing the computer program on the computer, the above-mentioned automatic sound field correcting device can be realized.

According to still another aspect of the present invention, there is provided an automatic sound field correcting method which executes a signal processing of an audio signal on a signal transmission path to output a processed audio signal to a correspondent speaker, including: a measurement signal supplying process which supplies a measurement signal to the signal transmission path; a measurement sound outputting process which outputs a measurement sound corresponding to the measurement signal from the speaker to a sound space; a detecting process which outputs the measurement signal sound outputted from the speaker as a detecting signal; a correction amount determining process which determines a correction amount used for a correction of a frequency characteristic; and a frequency characteristic correction process which corrects a frequency characteristic of an audio signal on the signal transmission path by using the correction amount determined in the correction amount determining process, wherein the correction amount determining process determines the correction amount based on the detecting signal at a first correction of the frequency characteristic, and determines the correction amount based on the detecting signal or an output signal by the frequency characteristic correction process at and after a second correction of the frequency characteristic. By the method, the above-mentioned automatic sound field correction can be realized.

The nature, utility, and further features of this invention will be more clearly apparent from the following detailed description with respect to preferred embodiment of the invention when read in conjunction with the accompanying drawings briefly described below.

BRIEF DESCRIPTION OF THE DRAWINGS

FIGS. 2A to 2C show correction patterns in the frequency characteristic correction;

FIG. 15 is a diagram for explaining a method of outputting block sound data in measuring a sound characteristic;

FIG. 16 is a diagram showing an example of calculating sound powers and total powers corresponding to block sound data;

FIG. 18 is a diagram showing a method of outputting block sound data in measuring a sound characteristic;

FIG. 19 is a diagram showing an example of calculating sound powers and total powers corresponding to block sound data;

DETAILED DESCRIPTION OF THE PREFERRED EMBODIMENTS

The preferred embodiments of the present invention will now be described below with reference to the attached drawings.

[Basic Principle]

Figure 1:
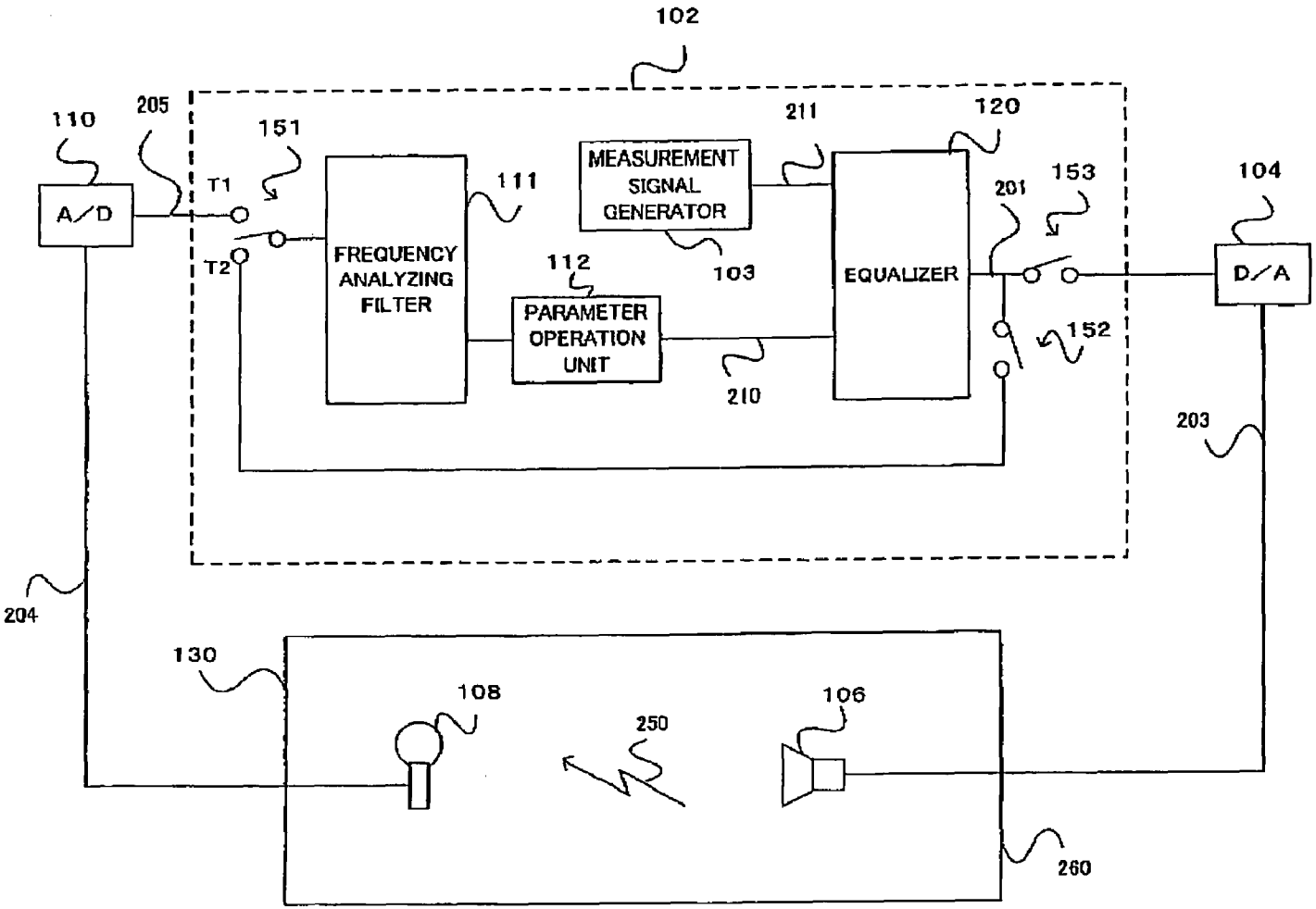
FIG. 1 is a block diagram showing a basic configuration of a frequency characteristic correction according to an embodiment of the present invention.

First, the description will be given of a basic principle of the frequency characteristics correction according to the present invention. FIG. 1 schematically shows a configuration for the frequency characteristics correction by an automatic sound field correcting system to which the present invention is applied. Though FIG. 1 shows the configuration for the frequency characteristics correction of only one channel (one frequency band) for convenience of the illustration, the correction can be actually performed for a plurality of frequency bands.

As shown in FIG. 1, the automatic sound field correcting system includes a signal processing unit (processor) 102, a D/A converter 104, a speaker 106, a microphone 108 and an A/D converter 110. The speaker 106 and the microphone 108 are disposed in a sound space 260. The signal processing unit 102 includes a frequency analyzing filter 111, a parameter (coefficient) operation unit 112, a measurement signal generator 103, an equalizer 120 and switches 151 to 153.

The measurement signal generator 103 supplies a measurement signal 211 for outputting a measurement sound to the equalizer 120. As the measurement sound, a pink noise is used, for example, and the measurement signal 211 may be a digital data of the pink noise. The measurement signal 211 generated by the measurement signal generator 103 is inputted to the equalizer 120.

The frequency characteristic of the measurement signal 211 is corrected by the equalizer 120, and then the measurement signal is transmitted to the switches 152 and 153 as a corrected measurement signal 201. When the switch 153 is in an ON state, the measurement signal 201 is converted to an analog measurement signal 203 by the D/A converter 104, and is supplied to the speaker 106. The speaker 106 is driven by the analog measurement signal 203, and outputs the pink noise to the sound space 260 as the measurement sound 250.

The outputted measurement sound 250 is collected by the microphone 108, and is supplied to the A/D converter 110 as an detecting signal 204. The A/D converter 110 converts the detecting signal 204 to a digital detecting signal 205. When the switch 151 is connected to an input terminal T1, the detecting signal 205 is supplied to the frequency analyzing filter 111 via the switch 151.

On the contrary, when the switch 152 is in the ON state and the switch 151 is connected to an input terminal T2, the measurement signal 201 outputted from the equalizer 120 is supplied to the frequency analyzing filter 111 via the switches 152 and 151. Namely, the digital measurement signal 201 outputted from the equalizer 120 is transmitted to the frequency analyzing filter 111 in the signal processing unit 102.

The frequency analyzing filter 111 frequency-analyzes the detecting signal 205 supplied from the A/D converter 110 or the measurement signal 201 supplied from the equalizer 120, and transmits a result thereof to the parameter operation unit 112. The parameter operation unit 112 determines a parameter (coefficient) of the equalizer 120 so that a gain of the channel (frequency band) becomes a target gain value, and sets the parameter 210 thus determined to the equalizer 120. In that way, the coefficients of the equalizer 120 are set and/or changed, and the frequency characteristic of the channel (frequency band) is corrected.

In the present embodiment, when the above-mentioned frequency characteristics correction is performed the plurality of times for each channel, at the first correction, the measurement sound 250 actually outputted to the sound space 260 is collected by the microphone 108, and the detecting signal 205 thus obtained is used. On the contrary, at and after the second frequency characteristics correction, the correction is performed by using the measurement signal 201 outputted from the equalizer 120 or the detecting signal 205 after performing the correction, according to need. Hereafter, for convenience of the explanation, it is prescribed that the frequency characteristics correction performed based on the detecting signal 205 obtained by collecting the measurement sound 250 outputted to the sound space 260 is called "frequency characteristics correction via the sound space", and the frequency characteristics correction performed based on the measurement signal 201 outputted from the equalizer 120 is called "frequency characteristics correction in the processor".

FIG. 2A shows a correction pattern example executed by combining the frequency characteristics correction via the sound space and the frequency characteristics correction in the processor at the time of performing the frequency characteristics correction plural times for each channel. In the example of FIG. 2A, in the plurality of the frequency characteristics correction, the frequency characteristics correction via the sound space is performed at the first correction, and the frequency characteristics correction in the processor is performed at and after the second correction.

As described above, the frequency characteristics correction via the sound space takes time longer than the frequency characteristics correction in the processor. Reasons thereof are a necessity of averaging the detecting signal 205 by outputting the measurement sound 250 and collecting the sound by the microphone 108 plural times for each correction process, and a necessity of ensuring a predetermined time interval for excluding an effect of the reverberation during repeatedly outputting the measurement sound 250. As another reason, since sampling frequencies of the D/A converter 104 and the A/D converter 110 are generally lower than a processing operation frequency (speed of the signal processing) in the signal processing unit 102, if the measurement sound 250 is actually outputted, the D/A conversion and the A/D conversion take longer time. In that point, at the frequency characteristics correction in the processor, the above-mentioned averaging is unnecessary. In addition, since the measurement sound is not actually outputted, the time interval is unnecessary between the correction processes, and the time for the D/A conversion and the A/D conversion is also unnecessary. Therefore, the frequency characteristics correction in the processor can be performed in a short time, in comparison with the frequency characteristics correction via the sound space.

In the present embodiment, when the frequency characteristics correction is performed plural times, the first frequency characteristics correction is performed via the sound space, and the second and subsequent frequency characteristics corrections are performed in the processor, according to need. Thus, the time necessary for the frequency characteristics correction is totally shortened. In the correction pattern example shown in FIG. 2A, only the first frequency characteristics correction is performed via the sound space, and all the subsequent frequency characteristics corrections are performed in the processor.

Next, the description will be given of the correction by the correction pattern example shown in FIG. 2A in detail. First, variables and invariables used for the frequency characteristics correction will be defined.

- bandnum: a number of channels (frequency bands) subjected to measurement
- Geqdb0[x]: equalizer parameter (coefficient),
  Note: x=0 to bandnum−1
- Geqdb1[x]: equalizer parameter for absorbing errors
- TARGET[x]: target frequency characteristic
  Note: when the frequency characteristics for all frequency bands are made flat, all of TARGET[x] to TARGET[bandnum−1] are set to "0".
- ROOM[x]: frequency characteristics (sound characteristics) of sound space and speaker
- Geqdb0_err[x]: error due to interference between frequency bands and characteristics error between frequency analyzing filter and equalizer
- Geqdb0_total[x]: synthesis characteristic in a case that Geqdb0[x] is simultaneously equalizer-processed for each frequency band (this is evaluated by the frequency analyzing filter)

It can be prescribed that $$Geqdb0_\mathrm{err}[x]=\mathrm{Geqdb0_total}[x]-Geqdb0[x] \quad (1)$$

(I) Case that All Frequency Characteristics Corrections are Performed Via Sound Space Next, for easy understanding, the description will be given of a case that all the frequency characteristics corrections of plural times are performed via the sound space, before the correction pattern example shown in FIG. 2A is explained.

(a) First Correction

If the target is assumed to make the frequency characteristics for all frequency bands flat as the frequency characteristics correction, all TARGET[x] are set to 0. In an initial state, the parameter Geqdb0[x] of the equalizer is set to 0. Since the first correction is the frequency characteristics correction via the sound space, the measurement sound 250 outputted from the speaker 106 for each frequency band is collected by the microphone 108, and is inputted from the A/D converter 110 to the frequency analyzing filter 111 as the detecting signal 205. The frequency analyzing filter 111 frequency-analyzes the detecting signal 205 of each frequency band, which is inputted from the A/D converter 110, and calculates the frequency characteristics ROOM[x] of the sound space and the speaker (hereafter, referred to as "space frequency characteristics") for each frequency band.

By using the target frequency characteristic TARGET[x] and the space frequency characteristic ROOM[x], the parameter operation unit 112 calculates the equalizer parameter of the first correction for each frequency band as follows:

$$1\mathrm{st}_Geqdb0[x]=\mathrm{TARGET}[x]-\mathrm{ROOM}[x] \quad (2).$$

The first equalizer parameter 1st_Geqdb0[x] for each frequency band is set to the equalizer 120.

(b) Second Correction

After the first equalizer parameter 1st_Geqdb0[x] is set to the equalizer 120 for each frequency band, the measurement sound 250 is outputted again, and the detecting signal 205 is obtained. The frequency analyzing filter 111 calculates the synthesis of the space frequency characteristic ROOM[x] and the synthesis characteristics 1st_Geqdb0_total[x] for each frequency band in a case that the equalizer parameter 1st_Geqdb0[x] of the first correction is simultaneously set to the equalizer 120 for all frequency bands, on the basis of the detecting signal 205. As shown by an equation (1), the synthesis characteristic 1st_Geqdb0_total[x] indicates a sum of the equalizer parameter 1st_Geqdb0[x] of the first correction and the error 1st_Geqdb0_err[x] due to the interference between the frequency bands.

Therefore, the equalizer parameter 2nd_Geqdb1 for absorbing the errors after the first measurement is obtained by an equation (3) below.

$$2\mathrm{nd}_Geqdb1[x]=\mathrm{TARGET}[x]-\mathrm{ROOM}[x]-1\mathrm{st}_Geqdb0_\mathrm{total}[x] \quad (3)$$

Therefore, by adding this equation (3) to the first equalizer parameter 1st_Geqdb0[x], the equalizer parameter 2nd_Geqdb0[x] of the second correction is obtained as follows:

$$2\mathrm{nd}_Geqdb0[x]=1\mathrm{st}_Geqdb0[x]+2\mathrm{nd}_Geqdb1[x] \quad (4)$$

(c) Third and Subsequent Corrections

At and after a third correction, similarly to the second correction, the equalizer parameter for absorbing the errors is calculated in the first place, and is added to the last equalizer parameter, thereby calculating a new equalizer parameter. Concretely, at the third correction, a third equalizer parameter is determined as follows:

$$3\mathrm{rd}_Geqdb1[x]=\mathrm{TARGET}[x]-\mathrm{ROOM}[x]-2\mathrm{nd}_Geqdb0_\mathrm{total}[x] \quad (5)$$

$$3\mathrm{rd}_Geqdb0[x]=2\mathrm{nd}_Geqdb0[x]+3\mathrm{rd}_Geqdb1[x] \quad (6)$$

As understood from the equations (2), (3) and (5), if the frequency characteristics correction is performed plural times, it is necessary that the measurement sound 250 is outputted to the sound space 260 and the space frequency characteristic ROOM[x] is obtained every time. However, actually, since a time period in which the frequency characteristics correction is performed is comparatively short, e.g., several tens of seconds, a system including the sound space and the automatic sound field correcting system may be regarded as unchangeable in terms of time. Therefore, in the present invention, as will be described below, by assuming that the system is unchangeable in terms of time during the time period in which the frequency characteristics correction is performed, the second and subsequent corrections are performed. Namely, the space frequency characteristic ROOM[x] is obtained once in the first correction, and the correction is performed basically by using the space frequency characteristic ROOM[x] obtained once, at and after the second correction. Thereby, as described above, since the second and subsequent corrections can be performed in the processor, the total correction time period can be remarkably shortened. Now, an explanation thereof will be given.

(II) Case that Only First Frequency Characteristics Correction is Performed Via Sound Space (a) First Correction Since the first correction is the frequency characteristics correction via the sound space, the correction is performed similarly to the above correction. Namely, the measurement sound 250 is outputted from the speaker 106 for each frequency band, and is collected by the microphone 108. The measurement sound thus collected is inputted from the A/D converter 110 to the frequency analyzing filter 111 as the detecting signal 205. The frequency analyzing filter 111 frequency-analyzes the detecting signal 205 for each frequency band inputted from the A/D converter 110, and calculates the space frequency characteristic ROOM[x] for each frequency band. It is noted that the calculation of the space frequency characteristic ROOM[x] is only once, and is never performed afterward.

By using the target frequency characteristic TARGET[x] and the space frequency characteristic ROOM[x], the parameter operation unit 112 calculates the equalizer parameter of the first correction for each frequency band as follows:

$$1st_Geqdb0[x]=TARGET[x]-ROOM[x] \quad (2).$$

The equalizer parameter 1st_Geqdb0[x] of the first correction for each frequency band of the sound space is set to the equalizer 120.

This value is a difference between the predetermined target frequency characteristic TARGET[x] and the space frequency characteristic ROOM[x], and can be a fixed value by assuming that the system is unchangeable in terms of the time, as explained above. Therefore, at and after the second frequency characteristics correction in the processor, "1st_Geqdb0[x]" is used instead of the value of "TARGET[x]−ROOM[x]".

(b) Second Correction

As shown in FIG. 2A, the second frequency characteristics correction is performed in the processor. Namely, after the equalizer parameter 1st_Geqdb0[x] of the first correction is set to the equalizer 120 for each frequency band, the measurement signal 211 is supplied to the equalizer 120, and the measurement signal 201 outputted from the equalizer 120 is supplied to the frequency analyzing filter 111 via the switches 152 and 151. As described above, the calculation of the space frequency characteristic ROOM[x] is not performed. The frequency analyzing filter 111 calculates the synthesis characteristic 1st_Geqdb0_total[x] for each frequency band in a case that the equalizer parameter 1st_Geqdb0[x] of the first correction is simultaneously set to the equalizer 120 for all frequency bands.

The equalizer parameter for absorbing the errors 2nd_Geqdb1[x] after the first measurement can be obtained by an equation (7).

$$2nd_Geqdb1[x]=1st_Geqdb0[x]-1st_Geqdb0_total[x] \quad (7)$$

As understood in comparison with the equation (3), the underlined portion becomes "1st_Geqdb0[x]" instead of the value of "TARGET[x]−ROOM[x]". This value is added to the equalizer parameter 1st_Geqdb0[x] of the first correction, and the equalizer parameter 2nd_Geqdb0[x] of the second correction is obtained as follows.

$$2nd_Geqdb0[x]1st_Geqdb0[x]+2nd_Geqdb1[x] \quad (8)$$

(c) Third and Subsequent Corrections

As shown in FIG. 2A, at and after a third correction, the frequency characteristics correction in the processor is performed. At and after the third correction, similarly to the second correction, the equalizer parameter for absorbing the errors is calculated in the first place, and is added to the last equalizer parameter to calculate the new equalizer parameter. Concretely, at the third correction, the equalizer parameter of the third correction is determined as follows.

$$3rd_Geqdb1[x]=1st_Geqdb0[x]-2nd_Geqdb0_total[x] \quad (9)$$

$$3rd_Geqdb0[x]=2nd_Geqdb0[x]+3rd_Geqdb1[x] \quad (10)$$

As understood in comparison with the equation (3), the underlined portion becomes "1st_Geqdb0[x]" instead of the value of "TARGET[x]−ROOM[x]". Subsequently, the frequency characteristics correction in the processor is similarly performed a predetermined number of times.

As described above, in the embodiment of the present invention, when the frequency characteristics correction is performed plural times, the first frequency characteristics correction is performed via the sound space, and the second and subsequent frequency characteristics corrections are performed in the processor. Thereby, the total time necessary for the frequency characteristics correction can be remarkably shortened.

FIG. 2B shows another correction pattern example of performing the frequency characteristics correction plural times. In the example of FIG. 2A, only the first frequency characteristics correction is performed via the sound space, and all the second and subsequent frequency characteristics corrections are performed in the processor. On the contrary, in the example of FIG. 2B, in a plurality of corrections, the first and last frequency characteristics corrections are performed via the sound space, and the other frequency characteristics corrections are performed in the processor. Generally, the reason for performing the frequency characteristics correction plural times is for gradually converging the errors after the correction, and the number of corrections is set to the number necessary for converging the errors within a predetermined range. Thus, the last frequency characteristics correction in the predetermined number of corrections may be confirmatively performed via the sound space. Though it is not shown, by the similar reason, only the first and last few (e.g., twice) corrections in the plurality of corrections may be performed as the frequency characteristics correction via the sound space, and the other corrections may be performed in the processor.

As shown in FIGS. 2A and 2B, when the frequency characteristics correction in the processor is performed, it is preferable that the measurement sound 250 is prevented from being outputted to the sound space 260 by setting the switch 153 in the OFF state, as a general rule. However, since it is not indispensable, there is no problem if the measurement sound 250 is outputted with the switch 153 in the ON state. But, even in that case, since the frequency characteristics correction in the processor is performed, collecting of the sound from the microphone 108 is not performed.

FIG. 2C shows a correction pattern example of outputting the measurement sound with the switch 153 in the ON state at the time of the frequency characteristics correction in the processor, which will be explained later.

[Automatic Sound Field Correcting System]

Next, the description will be given of an embodiment of the automatic sound field correcting system to which the present invention is applied, with reference to the attached drawings.

(I) System Configuration

Figure 3:
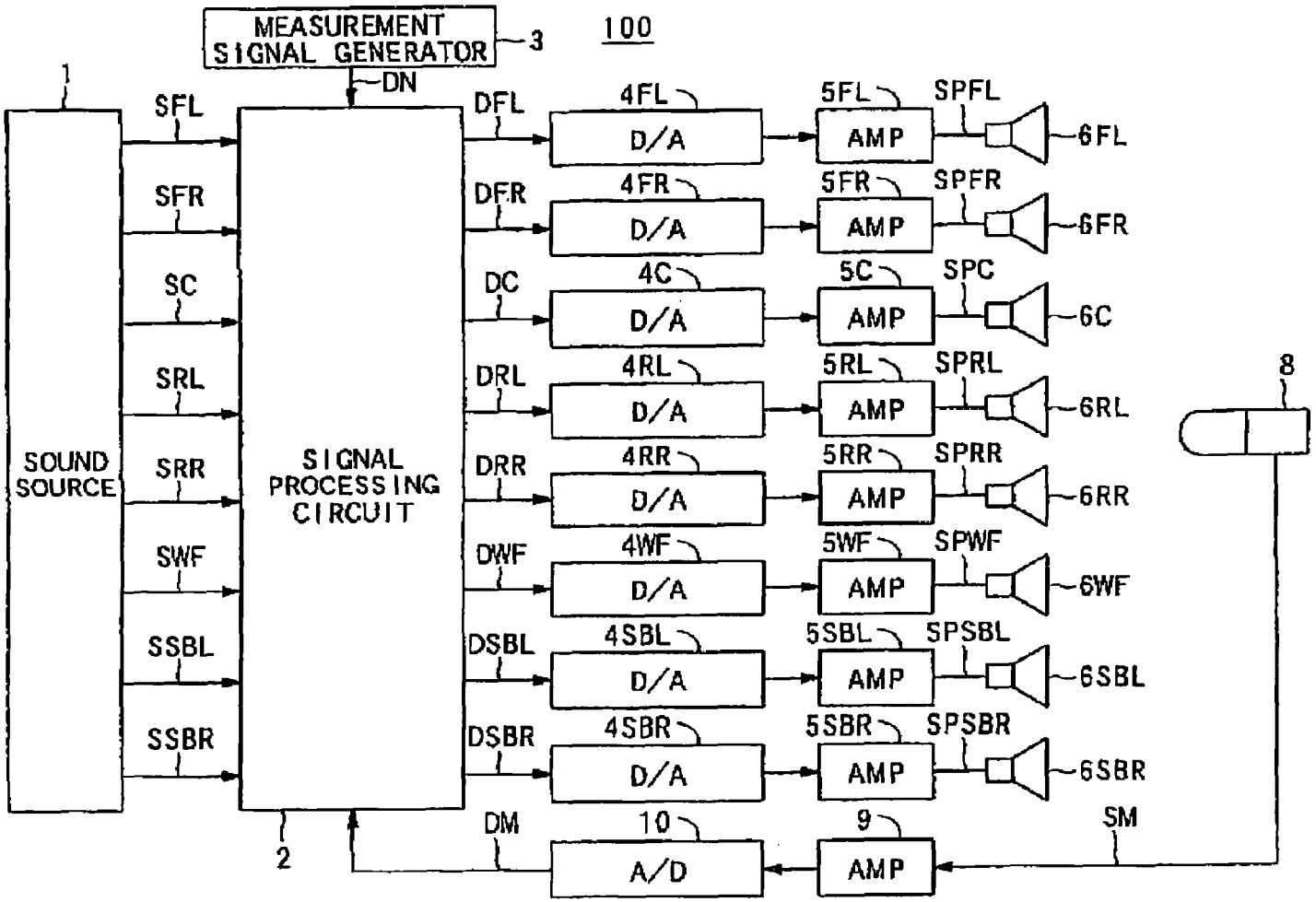
FIG. 3 is a block diagram showing a configuration of an audio system including an automatic sound field correcting system according to an embodiment of the present invention.

FIG. 3 is a block diagram showing a configuration of an audio system employing the automatic sound field correcting system of the present embodiment.

In FIG. 3, an audio system 100 includes a sound source 1 such as a CD (Compact Disc) player or a DVD (Digital Video Disc or Digital Versatile Disc) player, a signal processing circuit 2 to which the sound source 1 supplies digital audio signals SFL, SFR, SC, SRL, SRR, SWF, SSBL and SSBR via the multi-channel signal transmission paths, and a measurement signal generator 3.

While the audio system 100 includes the multi-channel signal transmission paths, the respective channels are referred to as "FL-channel", "FR-channel" and the like in the following description. In addition, the subscripts of the reference number are omitted to refer to all of the multiple channels when the signals or components are expressed. On the other hand, the subscript is put to the reference number when a particular channel or component is referred to. For example, the description "digital audio signals S" means the digital audio signals SFL to SSBR, and the description "digital audio signal SFL" means the digital audio signal of only the FL-channel.

Further, the audio system 100 includes D/A converters 4FL to 4SBR for converting the digital output signals DFL to DSBR of the respective channels processed by the signal processing by the signal processing circuit 2 into analog signals, and amplifiers 5FL to 5SBR for amplifying the respective analog audio signals outputted by the D/A converters 4FL to 4SBR. In this system, the analog audio signals SPFL to SPSBR after the amplification by the amplifiers 5FL to 5SBR are supplied to the multi-channel speakers 6FL to 6SBR positioned in a listening room 7, shown in FIG. 8 as an example, to output sounds.

The audio system 100 also includes a microphone 8 for collecting reproduced sounds at a listening position RV, an amplifier 9 for amplifying a collected sound signal SM outputted from the microphone 8, and an A/D converter 10 for converting the output of the amplifier 9 into a digital collected sound data DM to supply it to the signal processing circuit 2.

The audio system 100 activates full-band type speakers 6FL, 6FR, 6C, 6RL, 6RR having frequency characteristics capable of reproducing sound for substantially all audible frequency bands, a speaker 6WF having a frequency characteristic capable of reproducing only low-frequency sounds and surround speakers 6SBL and 6SBR positioned behind the listener, thereby creating sound field with presence around the listener at the listening position RV.

Figure 8:
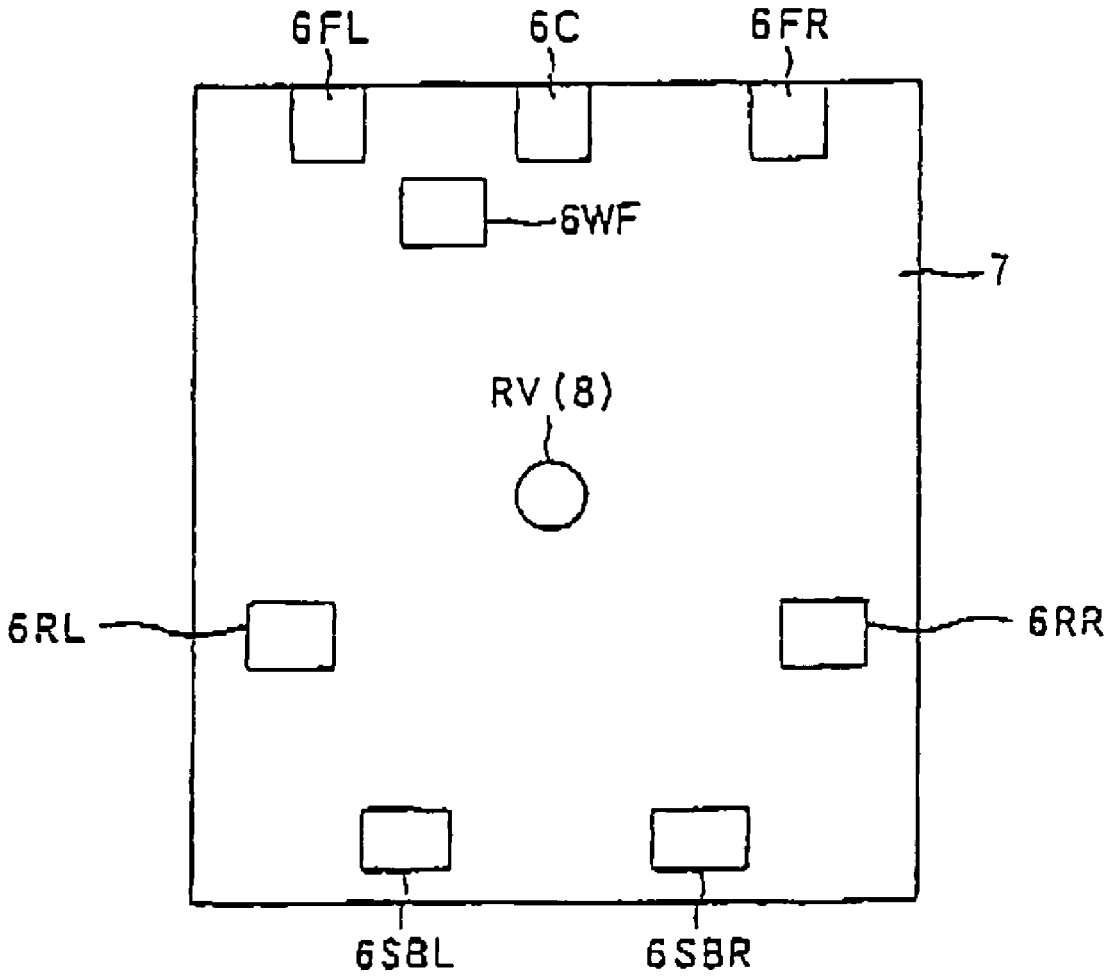
FIG. 8 is a diagram showing an example of speaker arrangement in a certain sound field environment.

With respect to the positions of the speakers, as shown in FIG. 8, for example, the listener places the two-channel, left and right speakers (a front-left speaker and a front-right speaker) 6FL, 6FR and a center speaker 6C, in front of the listening position RV, in accordance with the listener's taste. Also the listener places the two-channel, left and right speakers (a rear-left speaker and a rear-right speaker) 6RL, 6RR as well as two-channel, left and right surround speakers 6SBL, 6SBR behind the listening position RV, and further places the sub-woofer 6WF exclusively used for the reproduction of low-frequency sound at any position. The automatic sound field correcting system installed in the audio system 100 supplies the analog audio signals SPFL to SPSBR, for which the frequency characteristic, the signal level and the signal propagation delay characteristic for each channel are corrected, to those 8 speakers 6FL to 6SBR to output sounds, thereby creating sound field space with presence.

Figure 4:
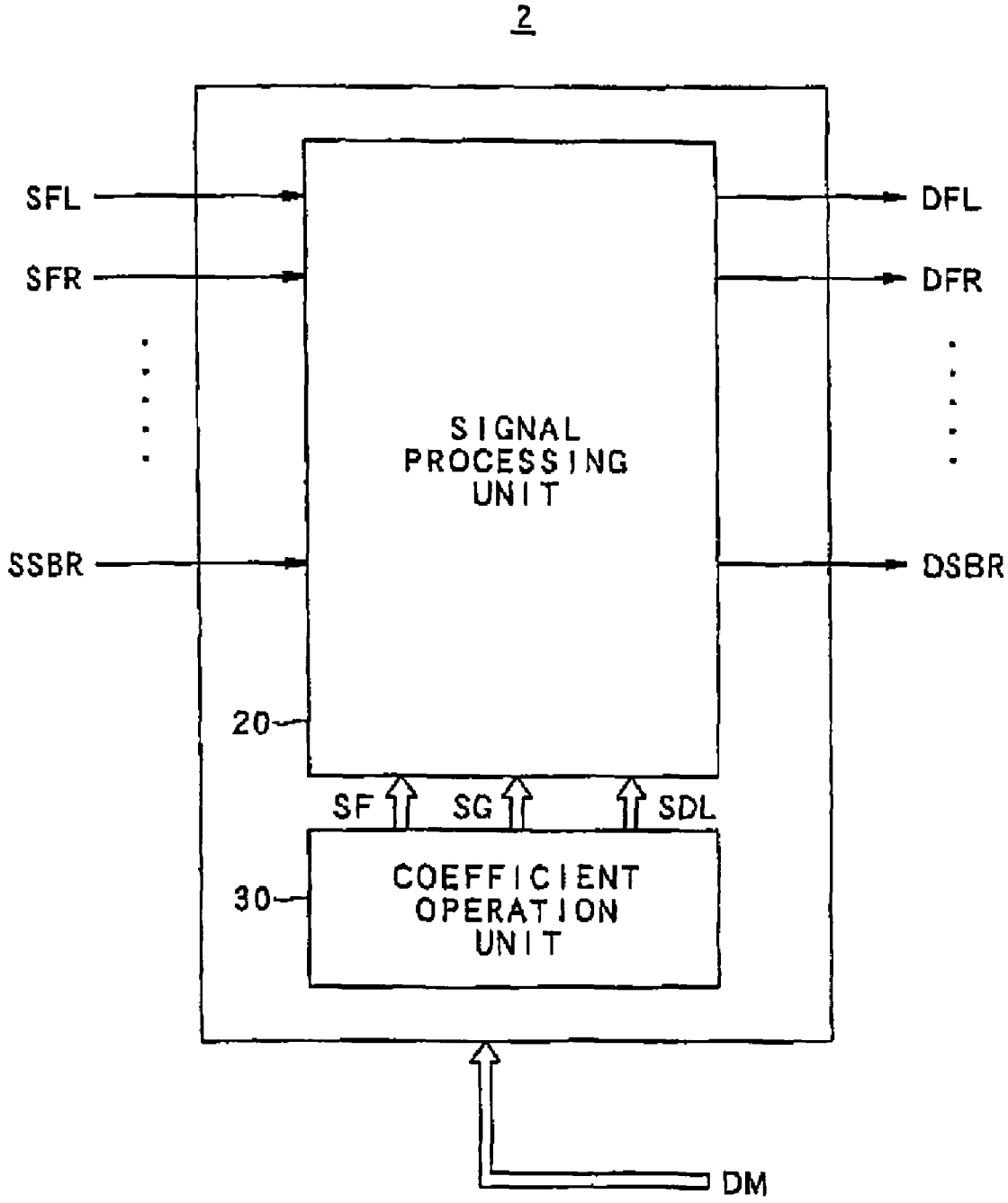
FIG. 4 is a block diagram showing an inner configuration of a signal processing circuit shown in FIG. 3.

The signal processing circuit 2 may have a digital signal processor (DSP), and roughly includes a signal processing unit 20 and a coefficient operation unit 30 as shown in FIG. 4. The signal processing unit 20 receives the multi-channel digital audio signals from the sound source 1 reproducing sound from various sound sources such as a CD, a DVD or else, and performs the frequency characteristics correction, the level correction and the delay characteristic correction for each channel to output the digital output signals DFL to DSBR.

The coefficient operation unit 30 receives the signal collected by the microphone 8 as the digital collected sound data DM, generates the coefficient signals SF1 to SF8, SG1 to SG8, SDL1 to SDL8 for the frequency characteristics correction, the level correction and the delay characteristics correction, and supplies them to the signal processing unit 20. As explained above, when the frequency characteristics correction via the sound space is performed, the coefficient operation unit 30 generates the coefficient signals SF1 to SF8 including the equalizer coefficient on the basis of the collected sound data DM. On the contrary, when the frequency characteristics correction in the processor is performed, the coefficient operation unit 30 generates the coefficient signals SF1 to SF8 on the basis of the measurement signal DMI. The signal processing unit 20 appropriately performs the frequency characteristics correction, the level correction and the delay characteristics correction based on the collected sound data DM from the microphone 8, and the speakers 6 output optimum sounds.

Figure 5:
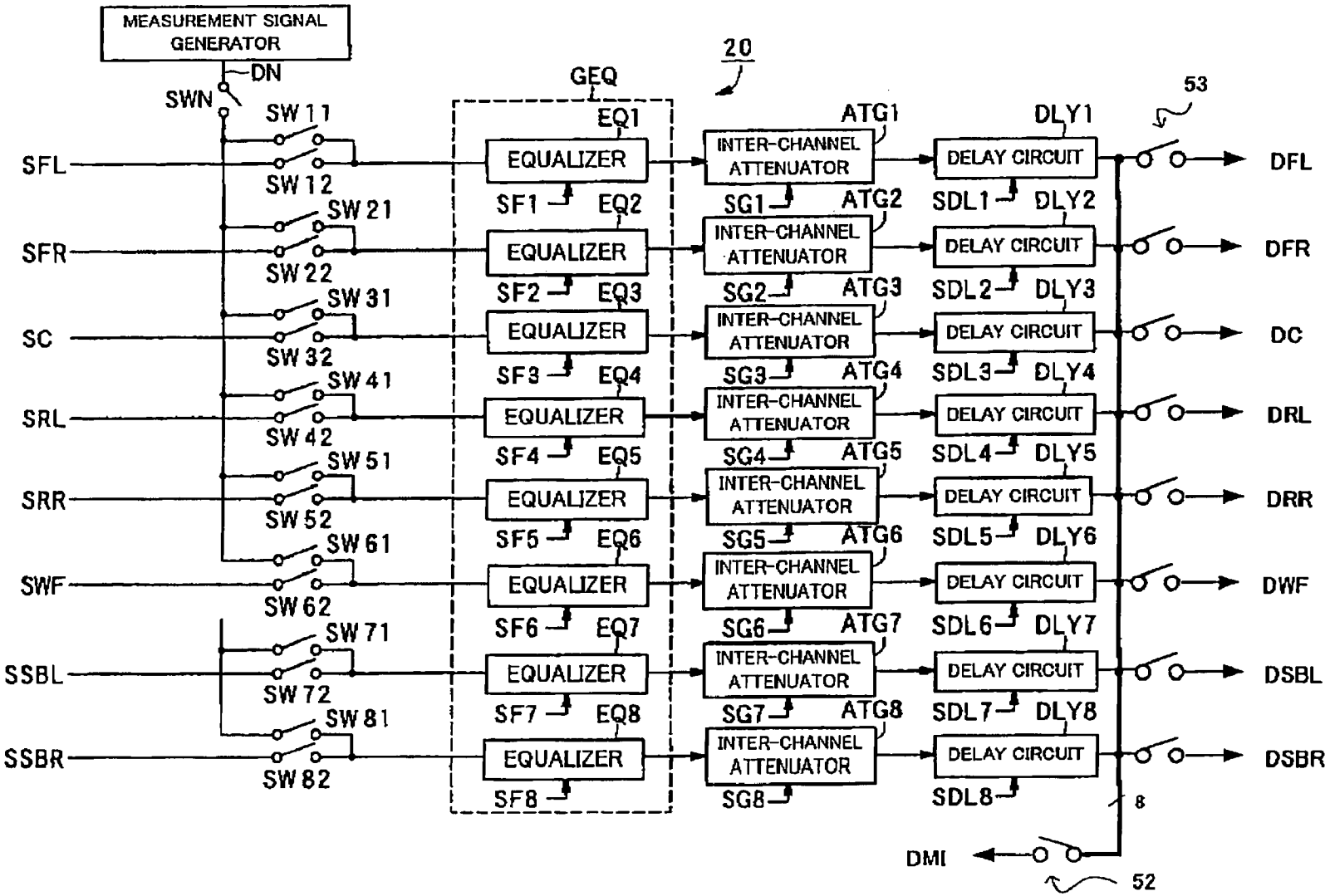
FIG. 5 is a block diagram showing a configuration of a signal processing unit shown in FIG. 4.
Figure 6:
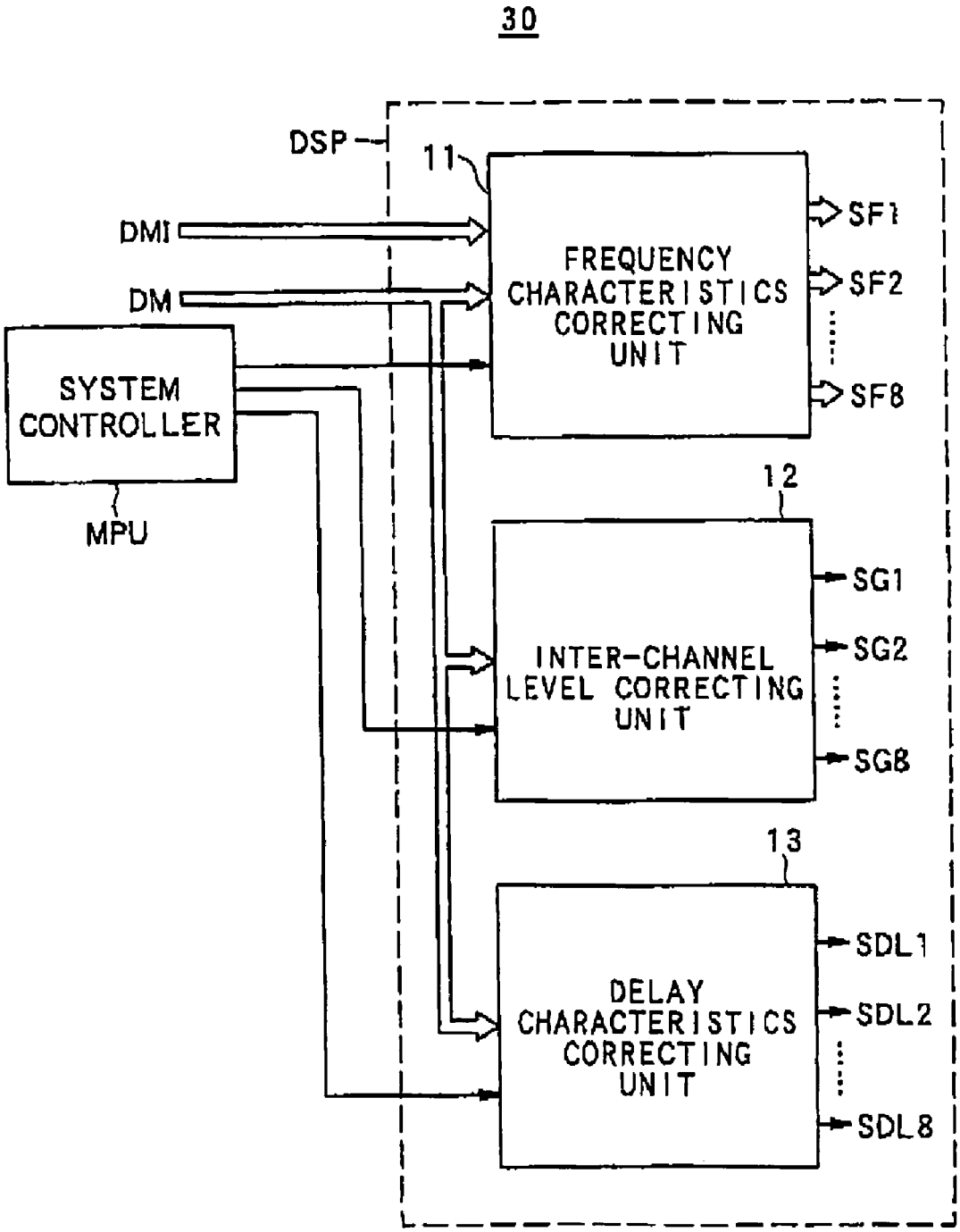
FIG. 6 is a block diagram showing a configuration of a coefficient operation unit shown in FIG. 2.

As shown in FIG. 5, the signal processing unit 20 includes a graphic equalizer GEQ, inter-channel attenuators ATG1 to ATG8, and delay circuits DLY1 to DLY8. On the other hand, the coefficient operation unit 30 includes, as shown in FIG. 6, a system controller MPU, a frequency characteristics correcting unit 11, an inter-channel level correcting unit 12 and a delay characteristics correcting unit 13. The frequency characteristics correcting unit 11, the inter-channel level correcting unit 12 and the delay characteristics correcting unit 13 constitute DSP.

The frequency characteristics correcting unit 11 sets the coefficients (parameter) of the equalizers EQ1 to EQ8 corresponding to the respective channels of the graphic equalizer GEQ, and adjusts the frequency characteristics of them. The inter-channel level correcting unit 12 controls the attenuation factors of the inter-channel attenuators ATG1 to ATG8, and the delay characteristics correcting unit 13 controls the delay times of the delay circuits DLY1 to DLY8, Thus, the sound field is appropriately corrected.

The outputs of the delay circuits DLY1 to DLY8 are supplied to the D/A converters 4 by making the switch 53 in the ON state, and are transmitted to the coefficient operation unit 30 by making the switch 52 made ON state. As described above, when the frequency characteristics correction via the sound space is performed, the switch 52 is made OFF state, and the switch 53 is made ON state. In addition, when the frequency characteristics correction in the processor is performed, the switch 52 is made ON state, and the switch 53 is made OFF state, as the general rule. For convenience of the illustration, in FIG. 5, the output signal supplied from the delay circuits DLY1 to DLY8 to the switch 52 is indicated by one signal line.

The equalizers EQ1 to EQ5, EQ7 and EQ8 of the respective channels are configured to perform the frequency characteristics correction for each frequency band. Namely, the audio frequency band is divided into 9 frequency bands (each of the center frequencies are f1 to f9), for example, and the coefficient of the equalizer EQ is determined for each frequency band to correct frequency characteristics. It is noted that the equalizer EQ6 is configured to control the frequency characteristic of low-frequency band.

The audio system 100 has two operation modes, i.e., an automatic sound field correcting mode and a sound source signal reproducing mode. The automatic sound field correcting mode is an adjustment mode, performed prior to the signal reproduction from the sound source 1, wherein the automatic sound field correction is performed for the environment that the audio system 100 is placed. Thereafter, the sound signal from the sound source 1 such as a CD player is reproduced in the sound source signal reproduction mode. An explanation below mainly relates to the correction operation in the automatic sound field correcting mode.

With reference to FIG. 5, the switch element SW12 for switching ON and OFF the input digital audio signal SFL from the sound source 1 and the switch element SW11 for switching ON and OFF the input measurement signal DN from the measurement signal generator 3 are connected to the equalizer EQ1 of the FL-channel, and the switch element SW11 is connected to the measurement signal generator 3 via the switch element SWN.

The switch elements SW11, SW12 and SWN are controlled by the system controller MPU configured by microprocessor shown in FIG. 6. When the sound source signal is reproduced, the switch element SW12 is turned ON, and the switch elements SW11 and SWN are turned OFF. On the other hand, when the sound field is corrected, the switch element SW12 is turned OFF and the switch elements SW11 and SWN are turned ON.

The inter-channel attenuator ATG1 is connected to the output terminal of the equalizer EQ1, and the delay circuit DLY1 is connected to the output terminal of the inter-channel attenuator ATG1, The output DFL of the delay circuit DLY1 is supplied to the D/A converter 4FL shown in FIG. 3.

The other channels are configured in the same manner, and switch elements SW21 to SWB1 corresponding to the switch element SW11 and the switch elements SW22 to SW82 corresponding to the switch element SWl2 are provided. In addition, the equalizers EQ2 to EQ8, the inter-channel attenuators ATG2 to ATG8 and the delay circuits DLY2 to DLY8 are provided, and the outputs DFR to DSBR from the delay circuits DLY2 to DLY8 are supplied to the D/A converters 4FR to 4SBR, respectively, shown in FIG. 3.

Further, the inter-channel attenuators ATG1 to ATG8 vary the attenuation factors within the range equal to or smaller than 0 dB in accordance with the adjustment signals SG1 to SG8 supplied from the inter-channel level correcting unit 12. The delay circuits DLY1 to DLY8 control the delay times of the input signal in accordance with the adjustment signals SDL1 to SDL8 from the phase characteristics correcting unit 13.

Figure 7A:
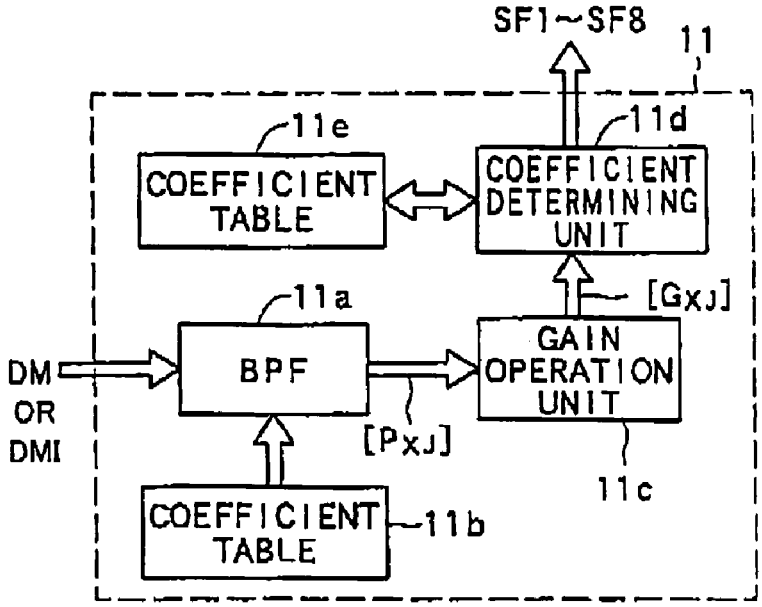
FIGS. 7A to 7C are block diagrams showing a configuration of a frequency characteristics correcting unit, an inter-channel level correcting unit and a delay characteristics correcting unit shown in FIG. 6.

The frequency characteristics correcting unit 11 has a function to adjust the frequency characteristic of each channel to have a desired characteristic. As shown in FIG. 6, the frequency characteristics correcting unit 11 analyzes the frequency characteristic of the collected sound data DM supplied from the A/D converter 10 or the measurement signal DMI supplied from the delay circuit DLY, and determines the coefficient adjusting signals SF1 to SF8 of the equalizers EQ1 to EQ8 in order to make the frequency characteristic be equal to the target frequency characteristic. As shown in FIG. 7A, the frequency characteristics correcting unit 11 includes a band-pass filter 11*a* as a frequency analyzing filter, a coefficient table 11*b*, a gain operation unit 11*c*, a coefficient determining unit 11*d* and a coefficient table 11*e*.

The band-pass filter 11*a* is configured by a plurality of narrow-band digital filters passing 9 frequency bands set to the equalizers EQ1 to EQ8. The band-pass filter 11*a* discriminates 9 frequency bands each including center frequency f1 to f9 from the collected sound data DM from the A/D converter 10, and supplies the data [PxJ] indicating the level of each frequency band to the gain operation unit 11*c*. The frequency discriminating characteristic of the band-pass filter 11*a* is determined based on the filter coefficient data stored, in advance, in the coefficient table 11*b*.

The gain operation unit 11*c* operates the gains of the equalizers EQ1 to EQ8 for the respective frequency bands at the time of the automatic sound field correction based on the data [PxJ] indicating the level of each frequency band, and supplies the gain data [GxJ] thus operated to the coefficient determining unit 11*d*. Namely, the gain operation unit 11*c* applies the data [PxJ] to the transfer functions of the equalizers EQ1 to EQ8 known in advance to calculate the gains of the equalizers EQ1 to EQ8 for the respective frequency bands in the reverse manner.

The coefficient determining unit 11*d* generates the filter coefficient adjustment signals SF1 to SF8, used to adjust the frequency characteristics of the equalizers EQ1 to EQ8, under the control of the system controller MPU shown in FIG. 6. It is noted that the coefficient determining unit 11*d* is configured to generate the filter coefficient adjustment signals SF1 to SF8 in accordance with the conditions instructed by the listener, at the time of the sound field correction. In a case where the listener does not instruct the sound field correction condition and the normal sound field correction condition preset in the sound field correcting system is used, the coefficient determining unit 11*d* reads out the filter coefficient data, used to adjust the frequency characteristics of the equalizers EQ1 to EQ8, from the coefficient table 11*e* by using the gain data [GxJ] for the respective frequency bands supplied from the gain operation unit 11*c*, and adjusts the frequency characteristics of the equalizers EQ1 to EQ8 based on the filter coefficient adjustment signals SF1 to SF8 of the filter coefficient data.

In other words, the coefficient table 11*e* stores the filter coefficient data for adjusting the frequency characteristics of the equalizers EQ1 to EQ8, in advance, in a form of a look-up table. The coefficient determining unit 11*d* reads out the filter coefficient data corresponding to the gain data [GxJ], and supplies the filter coefficient data thus read out to the respective equalizers EQ1 to EQ8 as the filter coefficient adjustment signals SF1 to SF8. Thus, the frequency characteristics are controlled for the respective channels.

Next, the description will be given of the inter-channel level correcting unit 12. The inter-channel level correcting unit 12 has a role to adjust the sound pressure levels of the sound signals of the respective channels to be equal. Specifically, the inter-channel level correcting unit 12 receives the collected sound data DM obtained when the respective speakers 6FL to 6SBR are individually activated by the measurement signal (pink noise) DN outputted from the measurement signal generator 3, and measures the levels of the reproduced sounds from the respective speakers at the listening position RV based on the collected sound data DM.

Figure 7B:
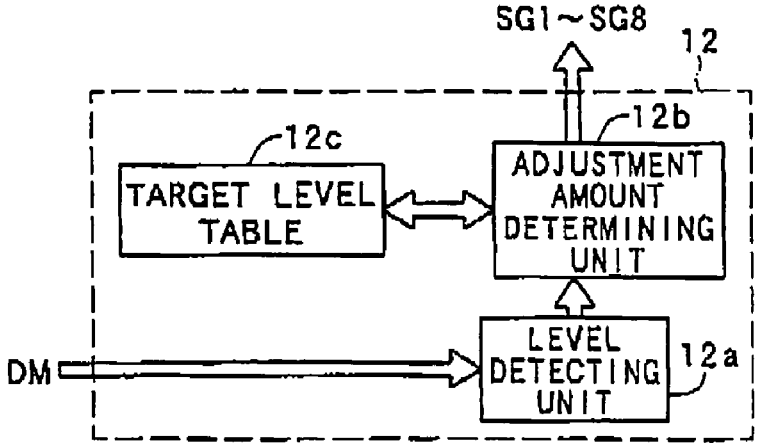

FIG. 7B schematically shows the configuration of the inter-channel level correcting unit 12. The collected sound data DM outputted by the A/D converter 10 is supplied to a level detecting unit 12*a*. It is noted that the inter-channel level correcting unit 12 uniformly attenuates the signal levels of the respective channels for all frequency bands and hence the frequency band division is not necessary. Therefore, the inter-channel level correcting unit 12 does not include any band-pass filter as shown in the frequency characteristics correcting unit 11 in FIG. 7A.

The level detecting unit 12*a* detects the level of the collected sound data DM, and carries out gain control so that the output audio signal levels for all channels become equal to each other. Specifically, the level detecting unit 12*a* generates the level adjustment amount indicating the difference between the level of the collected sound data thus detected and a reference level, and supplies it to an adjustment amount determining unit 12*b*. The adjustment amount determining unit 12*b* generates the gain adjustment signals SG1 to SG8 corresponding to the level adjustment amount received from the level detecting unit 12*a*, and supplies the gain adjustment signals SG1 to SG8 to the respective inter-channel attenuators ATG1 to ATG8. The inter-channel attenuators ATG1 to ATG8 adjust the attenuation factors of the audio signals of the respective channels in accordance with the gain adjustment signals SG1 to SG8. By adjusting the attenuation factors of the inter-channel level correcting unit 12, the level adjustment (gain adjustment) for the respective channels is performed so that the output audio signal level of the respective channels become equal to each other.

The delay characteristics correcting unit 13 adjusts the signal delay resulting from the difference in distance between the positions of the respective speakers and the listening position RV. Namely, the delay characteristics correcting unit 13 has a role to prevent that the output signals from the speakers 6 to be listened simultaneously by the listener reach the listening position RV at different times. Therefore, the delay characteristics correcting unit 13 measures the delay characteristics of the respective channels based on the collected sound data DM which is obtained when the speakers 6 are individually activated by the measurement signal (pink noise) DN outputted from the measurement signal generator 3, and corrects the phase characteristics of the sound field space based on the measurement result.

Specifically, by turning over the switches SW11 to SW82 shown in FIG. 5 one after another, the measurement signal DN generated by the measurement signal generator 3 is output from the speakers 6 for each channel, and the output sound is collected by the microphone 8 to generate the correspondent collected sound data DM. Assuming that the measurement signal is a pulse signal such as an impulse, the difference between the time when the speaker 6 outputs the pulse measurement signal and the time when the microphone 8 receives the correspondent pulse signal is proportional to the distance between the speaker 6 of each channel and the listening position RV. Therefore, the difference in distance of the speakers 6 of the respective channels and the listening position RV may be absorbed by setting the delay time of all channels to the delay time of the channel having maximum delay time. Thus, the delay time between the signals generated by the speakers 6 of the respective channels become equal to each other, and the sound outputted from the multiple speakers 6 and coincident with each other on the time axis simultaneously reach the listening position RV.

Figure 7C:
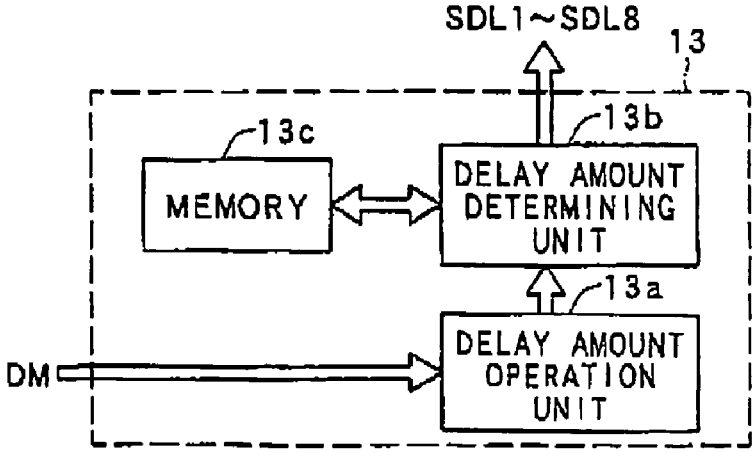

FIG. 7C shows the configuration of the delay characteristics correcting unit 13. A delay amount operation unit 13*a* receives the collected sound data DM, and operates the signal delay amount resulting from the sound field environment for the respective channels on the basis of the pulse delay amount between the pulse measurement signal and the collected sound data DM. A delay amount determining unit 13*b* receives the signal delay amounts for the respective channels from the delay amount operation unit 13*a*, and temporarily stores them in a memory 13*c*. When the signal delay amounts for all channels are operated and temporarily stored in the memory 13*c*, the delay amount determining unit 13*b* determines the adjustment amounts of the respective channels such that the reproduced signal of the channel having the largest signal delay amount reaches the listening position RV simultaneously with the reproduced sounds of other channels, and supplies the adjustment signals SDL1 to SDL8 to the delay circuits DLY1 to DLY8 of the respective channels. The delay circuits DLY1 to DLY8 adjust the delay amount in accordance with the adjustment signals SDL1 to SDL8, respectively. Thus, the delay characteristics for the respective channels are adjusted. It is noted that, while the above example assumed that the measurement signal for adjusting the delay time is the pulse signal, this invention is not limited to this, and other measurement signal may be used.

(II) Automatic Sound Field Correction

Next, the description will be given of the operation of the automatic sound field correction by the automatic sound field correcting system employing the configuration described above.

First, as the environment in which the audio system 100 is used, the listener positions the multiple speakers 6FL to 6SBR in a listening room 7 as shown in FIG. 8, and connects the speakers 6FL to 6SBR to the audio system 100 as shown in FIG. 3. When the listener manipulates a remote controller (not shown) of the audio system 100 to instruct the start of the automatic sound field correction, the system controller MPU executes the automatic sound field correction process in response to the instruction.

Figure 9:
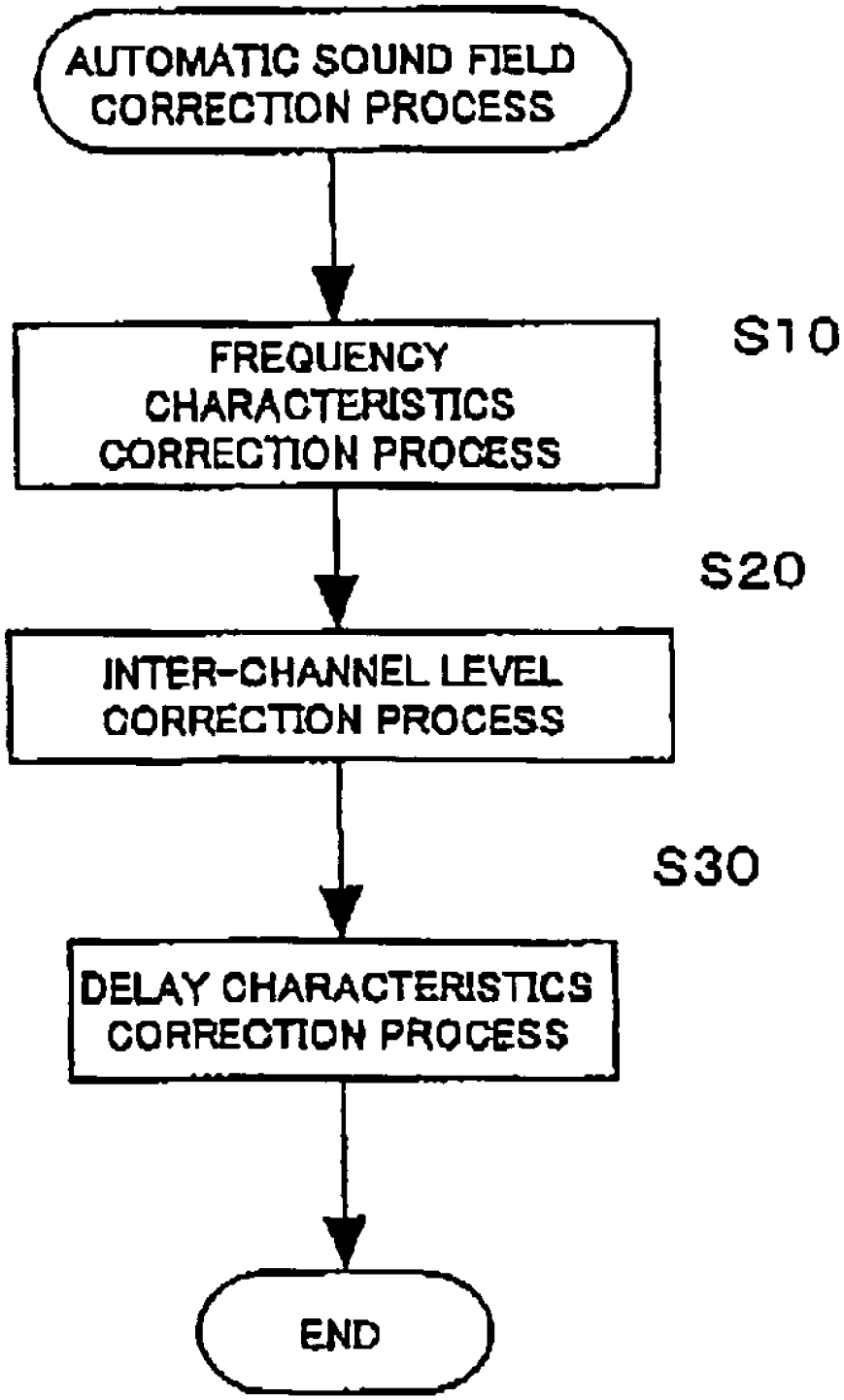
FIG. 9 is a flow chart showing a main routine of an automatic sound field correction process.

Next, the basic principle of the automatic sound field correction according to the present invention will be described. As described above, the processes executed in the automatic sound field correction are the frequency characteristic correction of each channel, the correction of the sound pressure level and the delay characteristics correction. The description will schematically be given of the automatic sound field correction process with reference to a flow chart shown in FIG. 9.

First, in step S10, the frequency characteristics correcting unit 11 adjusts the frequency characteristics of the equalizers EQ1 to EQ8. Next, in an inter-channel level correction process in step S20, the inter-channel level correcting unit 12 adjusts the attenuation factors of the inter-channel attenuators ATG 1 to ATG 8 provided for the respective channels. Next, in a delay characteristics correction process in step S30, the delay characteristics correcting unit 13 adjusts the delay time of the delay circuits DLY1 to DLY8 of all the channels. The automatic sound field correction according to the present invention is performed in this order.

Figure 10:
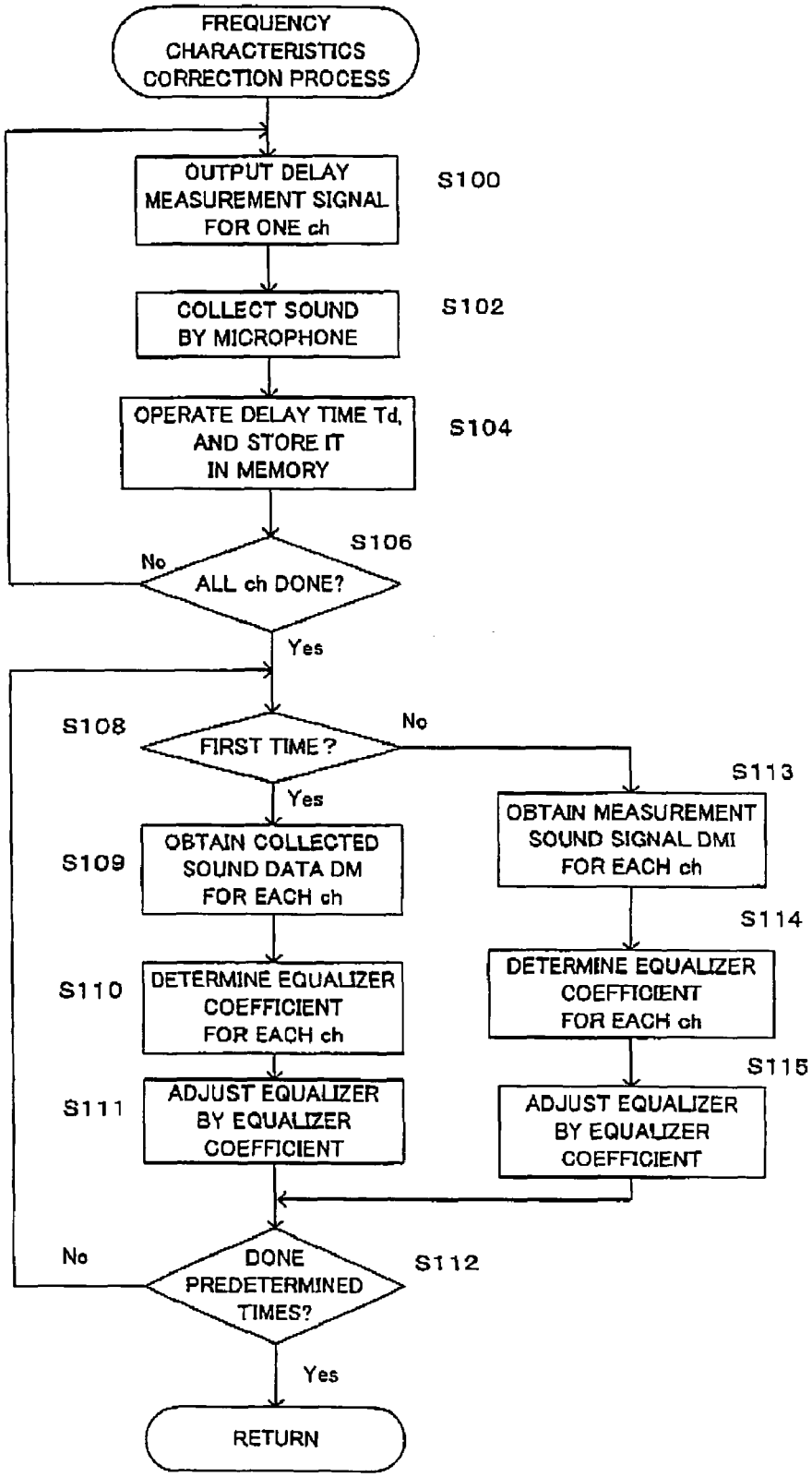
FIG. 10 is a flow chart showing a frequency characteristics correction process.

Next, the operation for each process will be explained in order with reference to FIG. 10. FIG. 10 is a flow chart of the frequency characteristics correction process according to the present embodiment. It is noted that the frequency characteristics correction process shown in FIG. 10 is for performing the delay measurement for each channel prior to the frequency characteristics correction process for each channel.

The delay measurement is the process of measuring a delay time from the output of the measurement signal by the signal processing circuit 2 until arrival of the correspondent collected sound data at the signal processing circuit 2, i.e., the process of pre-measuring the delay time Td for each channel. In FIG. 10, a procedure in steps S100 to S106 corresponds to the delay measurement process, and a procedure in steps S108 to S115 corresponds to an actual frequency characteristics correction process.

In FIG. 10, the signal processing circuit 2 outputs the pulse delay measurement signal in one of the plural channels at first, and the signal is outputted from the speaker 6 as the measurement signal sound (step S100). The measurement signal sound is collected by the microphone 8, and the collected sound data DM is supplied to the signal processing circuit 2 (step S102). The frequency characteristics correcting unit 11 in the signal processing circuit 2 operates the delay time Td, and stores it in its memory and the like (step S104). When the process of all the steps S100 to S104 is executed with respect to all the channels (step S106; Yes), the delay times Td of all the channels are stored in the memory. Thus, the delay time measurement is completed.

Next, the frequency characteristics correction is performed the predetermined number of times for each channel. First, the signal processing circuit 2 determines whether the correction is the first frequency characteristics correction or not (step S108). As shown in FIG. 2A, it is now assumed that only the first frequency characteristics correction is performed via the sound space, and all the second and subsequent frequency characteristics corrections are performed in the processor. When the correction is the first frequency characteristics correction (step S108; Yes), the signal processing circuit 2 outputs the frequency characteristics measurement signal such as the pink noise for each channel, and the signal is outputted from the speaker 6 as the measurement signal sound. The measurement signal sound is collected by the microphone 8, and the collected sound data DM is obtained in the frequency characteristics correcting unit 11 of the signal processing circuit 2 (step S109). The gain operation unit 11*c* in the frequency characteristics correcting unit 11 analyzes the collected sound data, and the coefficient determining unit 11*d* sets the equalizer coefficient (step S110). Based on the equalizer coefficient, the equalizer is adjusted (step S111). In that way, the adjustment of the frequency characteristics is completed for each channel on the basis of the collected sound data DM.

Next, the signal processing unit 2 determines whether the frequency characteristics corrections of the predetermined number are completed or not (step S112). When the corrections are not completed, the process returns to step S108. In the second or subsequent frequency characteristic correction (step S108; No), the signal processing unit 2 obtains not the collected sound data DM but the measurement signal DMI outputted from the delay circuit DLY of each channel (step S113). As described above, the signal processing unit 2 performs the frequency analysis, and determines the equalizer coefficient (step S114). By using the equalizer coefficient, the equalizer EQ is adjusted (step S115). When the frequency characteristics corrections of the predetermined number are completed (step S112; Yes), the frequency characteristics correction is completed.

Here, the description was given of the case that only the first frequency characteristics correction is performed via the sound space and all the second and subsequent frequency characteristics corrections are performed in the processor, as shown in FIG. 2A. However, at and after the second correction, the frequency characteristics correction via the sound space can be performed, if appropriate. In that case, in step S108, it may be determined which one of the frequency characteristics correction via the sound space (steps S109 to S111) or the frequency characteristics correction in the processor (steps S113 to S115) is to be performed, in accordance with the number of correction.

Figure 11:
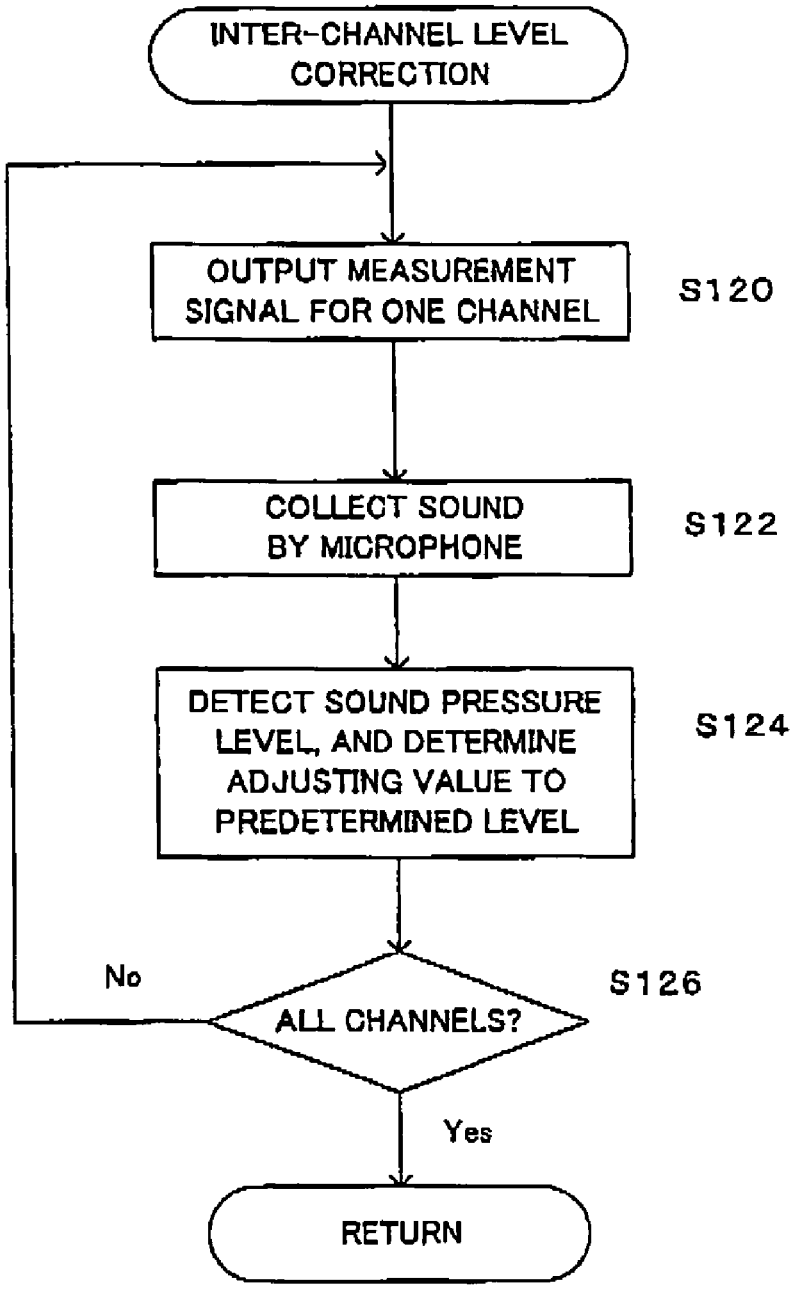
FIG. 11 is a flow chart showing an inter-channel level correction process.

Next, an inter-channel level correction process in step S20 is performed. The inter-channel level correction process is performed in accordance with the flow chart shown in FIG. 11. In the inter-channel level correction process, the correction is performed by maintaining a state in which the frequency characteristic of the graphic equalizer GEQ set by the previous frequency characteristics correction process is adjusted by the above-mentioned frequency characteristics correction process.

In the signal processing unit 20 shown in FIG. 5, by making the switch SW11 in the ON state and the switch SW12 in the OFF state in the first place, the measurement signal DN (pink noise) is supplied to the one channel (e.g., FL channel), and the measurement signal DN is outputted from the speaker 6FL (step S120). The microphone 8 collects the signal, and the collected sound data DM is supplied to the inter-channel level correcting unit 12 in the coefficient operation unit 30 via the amplifier 9 and the A/D converter 10 (step S122). In the inter-channel level correcting unit 12, the level detecting unit 12*a* detects the sound pressure level of the collected sound data DM, and transmits it to the adjustment amount determining unit 12*b*. The adjustment amount determining unit 12*b* generates the adjusting signal SG1 of the inter-channel attenuator ATG1 so that the detected sound pressure level corresponds to the predetermined sound pressure level which is set to a target level table 12*c* in advance, and supplies the adjusting signal SG1 to the inter-channel attenuator ATG1 (step S124). In that way, the correction is performed so that the sound pressure level of the one channel corresponds to the predetermined sound pressure level. The process is executed for each channel in order, and when the level correction is completed for all the channels (step S126; Yes), the process returns to the main routine in FIG. 9.

Figure 12:
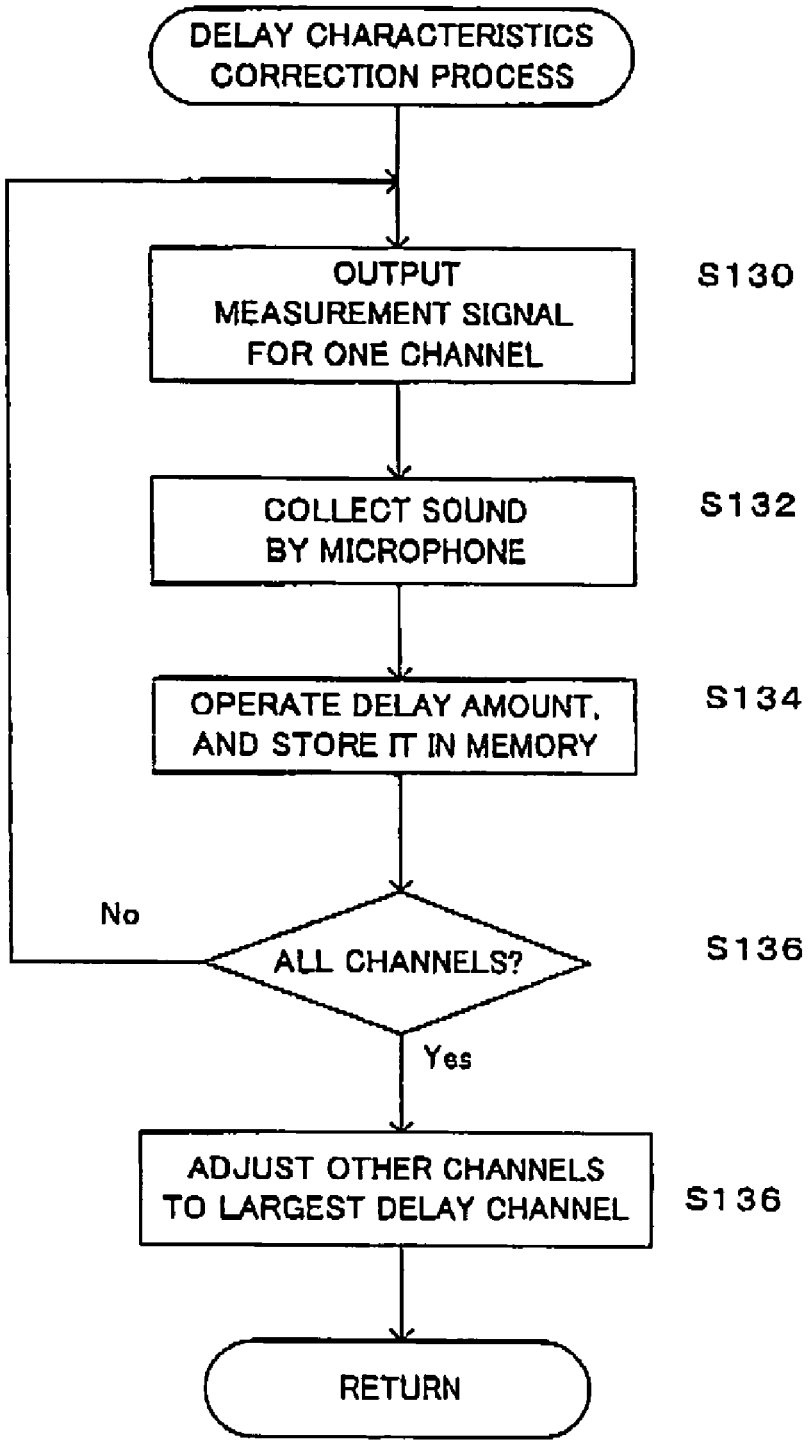
FIG. 12 is a flow chart showing a delay correction process.

Next, the delay characteristics correction process in step S30 is executed in accordance with a flow chart shown in FIG. 12. First, by making the switch SW11 in the ON state and the switch SW12 in the OFF state for the one channel (e.g., FL channel), the measurement signal DN is outputted from the speaker 6 (step S130). Next, the outputted measurement signal DN is collected by the microphone 8, and the collected sound data DM is inputted to the delay characteristics correcting unit 13 in the coefficient operation unit 30 (step S132). In the delay characteristics correcting unit 13, the delay amount operation unit 13*a* operates the delay amount of the channel, and temporarily stores it in the memory 13*c* (step S134). The process is executed for all the channels. When the process is completed for all the channels (step S136; Yes), the memory 13*c* stores the delay amount of all the channels. Next, the coefficient operation unit 13*b* determines the coefficients of the delay circuits DLY1 to DLY8 for the respective channels with respect to a channel having the largest delay amount in all channels on the basis of the storage contents of the memory 13*c* so that the sounds of all the channels simultaneously reach the listening position RV. Then, the coefficient operation unit 13*b* supplies the coefficient to the delay circuits DLY1 to DLY8 (step 5138). Thereby, the delay characteristics correction is completed.

In that way, the frequency characteristic, the inter-channel level and the delay characteristic are corrected, and the automatic sound field correction is completed.

In the above embodiment, the description was given of the case that the equalizer was used as the frequency characteristics correcting unit for correcting the frequency characteristic for each channel. Instead, the frequency characteristics correcting unit may include a band pass filter of each frequency band, a variable amplifier connected to the output of each band pass filter for adjusting the gain of each frequency band, and an adder for synthesizing the signal of each frequency band.

[Application]

(I) Application of Frequency Characteristics Measurement Technique of Short Time Width In the above-mentioned automatic sound field correcting system, the measurement sound signal (digital signal) prepared in advance, such as the pink noise, is outputted from the speaker 6 as the measurement sound, and is collected by the microphone 8. Thereby, the collected sound data DM is generated. On the contrary, as described below, the measurement sound signal prepared in advance may be divided into the plurality of the block sound data of the short time widths, and they maybe outputted plural times with the reproduction order shifted to collect the sound (hereafter, referred to as "shift operation"). Thereby, the frequency characteristic of the system can be obtained in the time width shorter than the time width of the original measurement sound signal (hereafter, referred to as "frequency characteristics measurement technique of short time width"). When the technique is adopted, in the one frequency characteristics correction, the measurement sound signal is reproduced plural times by shifting it by the unit of the block sound data, and the collected sound data is obtained. Therefore, the processing time necessary for the one correction becomes comparatively longer.

Thus, in the present embodiment, by performing the shift operation at the first correction, the measurement sound is outputted from the speaker 6, and is collected by the microphone 8. Based on the collected sound data DM, the frequency characteristics correction is performed. On the contrary, the shift operation is not performed at and after the second correction, and the frequency characteristics correction in the processor is performed by using the measurement sound signal prepared in advance. In that case, the measurement sound may be outputted from the speaker 6, or the output can be inhibited. However, collecting of the sound by the microphone 8 is not performed. FIG. 2C shows this correction pattern. Contents of parentheses at and after 2nd time in FIG. 2C indicate switching states in a case of outputting the measurement sound.

As described above, the causes that the frequency characteristics correction via the sound space needs time are the necessity of time for averaging, the necessity of outputting the measurement sound at the time interval for excluding the effect of the reverberation sound, and the necessity of the processing time of the D/A converter and the A/D converter. However, they are smaller than the time necessary for the above-mentioned shift operation. Thus, in the automatic sound field correcting system adopting the frequency characteristics measurement technique of the short time width by the shift operation, if only the shift operation is omitted at and after the second correction, the total processing time can comparatively be shortened.

(II) Frequency Characteristics Correction Technique of Short Time Width

The description will be given of the frequency characteristics correction technique of the short time width by the shift operation below.

Figure 13:
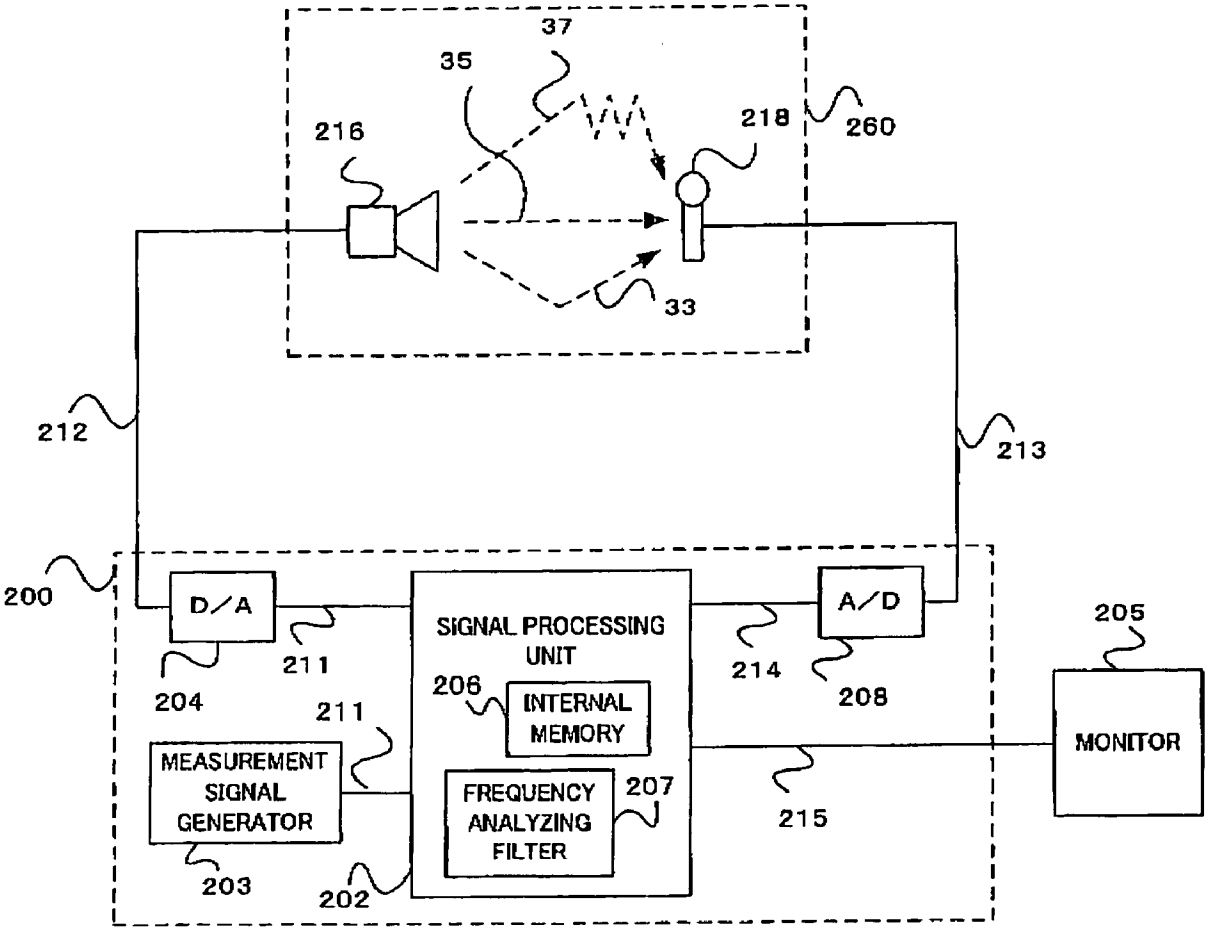
FIG. 13 schematically shows a configuration of a sound characteristics measurement system to which a frequency characteristics measurement technique of a short time width is applied.

First, the description will be given of the sound characteristic measurement system by the present technique. FIG. 13 schematically shows a configuration of the sound characteristic measurement system according to the present embodiment. As shown in FIG. 1, the sound characteristic measurement system includes a sound characteristic measuring device 200, and a speaker 216, a microphone 218 and a monitor 205 which are connected to the sound characteristic measuring device 200, respectively. The speaker 216 and the microphone 218 are provided in the sound space 260 subjected to measurement. Typical examples of the sound space 260 are a listening room, a home theater and the like.

The sound characteristic measuring device 200 includes a signal processing unit 202, a measurement signal generator 203, a D/A converter 204 and an A/D converter 208. The signal processing unit 202 includes an internal memory 206 and a frequency analyzing filter 207 inside. The signal processing unit 202 supplies digital measurement sound data 211 outputted from the measurement signal generator 203 to the D/A converter 204, and the D/A converter 204 converts the measurement sound data 211 to an analog measurement signal 212 to supply it to the speaker 216. The speaker 216 outputs, to the sound space 260 subjected to the measurement, the measurement sound corresponding to the supplied measurement signal 212.

The microphone 218 collects the measurement sound outputted to the sound space 260, and supplies, to the A/D converter 208, a detecting signal 213 corresponding to the measurement sound. The A/D converter 208 converts the detecting signal 213 to a digital detected sound data 214, and supplies it to the signal processing unit 202.

In the sound space 260, the measurement sound outputted from the speaker 216 is collected by the microphone 218 mainly as a combination of a direct sound component 35, an initial reflective sound component 33 and a reverberation sound component 37. The signal processing unit 202 can obtain the sound characteristic of the sound space 260 on the basis of the detected sound data 214 corresponding to the measurement sound collected by the microphone 218. For example, by calculating a sound power for each frequency band, the signal processing unit 202 can obtain the reverberation characteristic for each frequency band of the sound space 260.

The internal memory 206 is a storage unit which temporarily stores the detected sound data 214 obtained via the microphone 218 and the A/D converter 208, and the signal processing unit 202 executes a process, such as an operation of the sound power, by using the detected sound data temporarily stored in the internal memory 206, and obtains the sound characteristic of the sound space 260. For example, the signal processing unit 202 can generate the reverberation characteristic of all frequency bands (i.e., full frequency band) to display it on a monitor 205. Also, the signal processing unit 202 can generate the reverberation characteristic for each frequency band by using the frequency analyzing filter 207 to display it on the monitor 205.

Figure 14:
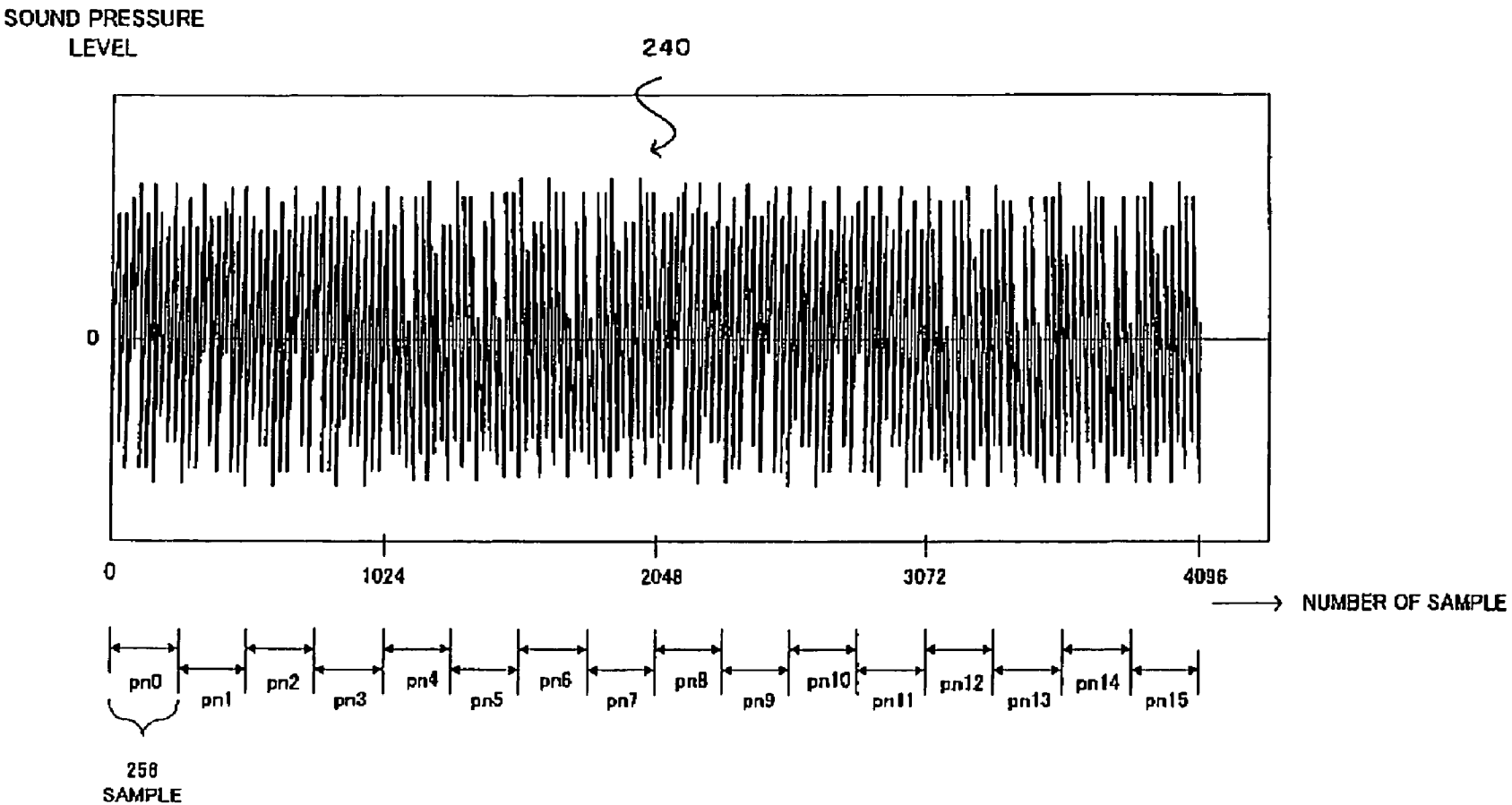
FIG. 14 shows a waveform example of measured sound data.

Next, a method of measuring the sound characteristic will be explained in detail. FIG. 14 shows a waveform example of a pink noise, which is an example of the measurement signal. The measurement signal may be a signal including the frequency component of the frequency band subjected to the measurement, and is not limited to the pink noise. In the example shown in FIG. 14, the pink noise including 4096 samples (about 80 ms) is prepared as digital data (hereafter, also referred to as "measurement sound data 240"). The measurement signal generator 203 includes a memory which stores the measurement sound data 240, and can output all the blocks or only a certain block of the measurement sound data 240 in accordance with the address given from the signal processing unit 202.

In the present embodiment, the measurement sound data 240 is divided into plural blocks (hereafter, referred to as "block sound data pn"). While the output order of the block sound data pn is shifted, the measurement sound is measured for plural times by the microphone 218, and obtained results are synthesized to continuously measure the sound power which is timely varying. Concretely, as shown in FIG. 14, the measurement sound data 240 including 4096 samples are divided into 16 short-time block sound data pn0 to pn15. The respective block sound data pn0 to pn15 have time width including 256 samples (corresponding to about 5 ms). At the time of measuring the sound characteristic, the block sound data pn are reproduced via the D/A converter 204 and the speaker 216 to be outputted to the sound space 206 as the measurement sound, in sequence. Thereby, the measurement is performed.

FIG. 15 shows the output (reproduction) order of the block sound data pn0 to pn15. In the present embodiment, as described above, the measurement sound data 240 including 4096 samples is divided into 16 block sound data pn0 to pn15 each including 256 samples, and they are continuously outputted in accordance with a reproduction order pattern shown in FIG. 15. Thereby, the measurement is performed. At that time, although the reproduction order of the 16 block sound data pn0 to pn15 follows the order shown in FIG. 14 in which the measurement sound data 240 is formed, the block sound data reproduced first is shifted by one block in each measurement, and the measurement is performed for all patterns of the reproduction order shown in FIG. 15, i.e., for 16 times.

It is noted that "block periods" T0 to T15 shown in FIG. 15 indicate positions of the respective block sound data pn0 to pn15 on the time axis of the whole measurement sound data 240 shown in FIG. 14. For example, the block period T0 corresponds to 256 samples included in the first block sound data pn0 of the measurement sound data 240 (i.e., the period approximately between 0 ms and 5 ms), and the block period T1 corresponds to 256 samples included in the next block sound data pn1 (i.e., the period approximately between 5 ms and 10 ms). The block period T15 corresponds to 256 samples included in the last block sound data pn15 of the measurement sound data 240 (i.e., the period approximately between 75 ms and 80 ms).

As shown in FIG. 15, in the present embodiment, with shifting the block sound data reproduced first by one, the block sound data pn0 to pn15 are outputted for all the patterns of the reproduction order, and the measurement is performed 16 times in total. Namely, at the first measurement, 16 block sound data pn are continuously outputted in the order of the block sound data pn0 to pn15, and the measurement is performed. At the second measurement, a reproduction starting position of the block sound data pn is shifted on the right side on the graph shown in FIG. 14 by one block, and 16 block sound data pn are continuously outputted in the order of the block sound data pn1 to pn15 and pn0, and the measurement is performed. The process is repeated in the above way. At the 16th measurement, 16 block sound data pn are continuously outputted in the order of the block sound data pn15 first, and pn0 to pn14 subsequently, and the measurement is performed.

During the measurement, the microphone 218 collects the measurement sound data 240 by the unit of each block sound data pn, and the signal processing unit 202 receives the detected sound data 214 from the A/D converter 208. The signal processing unit 202 stores, in the internal memory 206, the detected sound data of 256 samples, similarly to the unit of the block sound data pn, as one unit of detected sound data in the present embodiment. Also, the signal processing unit 202 calculates a sound power md on the basis of the detected sound data, and temporarily stores it in the internal memory 206. By assuming that the detected sound data of one block corresponding to one block sound data pn is formed by 256 samples from $d_1$ to $d_{256}$, the sound power "md" of the detected sound data of that one block is given by an equation below.

$$md=d_1^2+d_2^2+d_3^2+\ldots d_{256}^2 \tag{11}$$

FIG. 16 shows the sound powers thus obtained, corresponding to the block sound data pn. In FIG. 16, the sound power md0 corresponds to the block sound data pn0, and the sound power md1 corresponds to the block sound data pn1. Identically, the sound power md15 corresponds to the block sound data pn15. Comparing FIG. 15 and FIG. 17, in FIG. 17, the correspondent sound power md is indicated at the position corresponding to the block sound data pn of each measurement number of FIG. 15.

The signal processing unit 202 totals the sound powers md thus obtained, corresponding to each block sound data pn, for each block period (T0 to T15), and calculates total powers rv0 to rv15. Namely, the signal processing unit 202 adds the first to sixteenth sound powers md in the column direction for each block time shown in FIG. 16, and calculates the total power rv. Concretely, the total powers rv0 to rv15 are calculated by the equations below.

$$\begin{aligned} rv0 &= md0 + md1 + md2 + \ldots + md15 \\ rv1 &= md1 + md2 + md3 + \ldots + md0 \\ rv2 &= md2 + md3 + md4 + \ldots + md1 \\ &\vdots \\ rv15 &= md15 + md0 + md1 + \ldots + md14 \end{aligned} \tag{12}$$

As understood from FIG. 14 to FIG. 16, each of the total powers rv0 to rv15 is the sum of the sound powers md0 to md15 of the detected sound data corresponding to all the block sound data pn0 to pn15 in the correspondent block period. Namely, each of the total powers rv0 to rv15 indicates a response of the sound space 260 corresponding to all the components of the measurement sound data 240 in the block period. For example, the total power rv0 indicates the response (sound power) corresponding to all the measurement sound data 240 in the block period T0, i.e., within about 5 ms from the measurement starting time (see FIG. 14). In addition, the total power rv1 indicates the sound power corresponding to all the measurement sound data 240 in the block period T1, i.e., within the time period from 5 ms to 10 ms after starting the measurement. Like this, in the present embodiment, the measurement sound data 240 is divided into the plural short-time block sound data pn0 to pn15, and the sound powers are measured for all the patterns of the reproduction order with shifting the reproduction order by one block every time, thereby to calculate the total power for each block period. Thus, it becomes possible to obtain the instantaneous sound characteristic or the sound characteristic in the time width much smaller than the time width of the whole measurement sound data 240.

Figure 17:
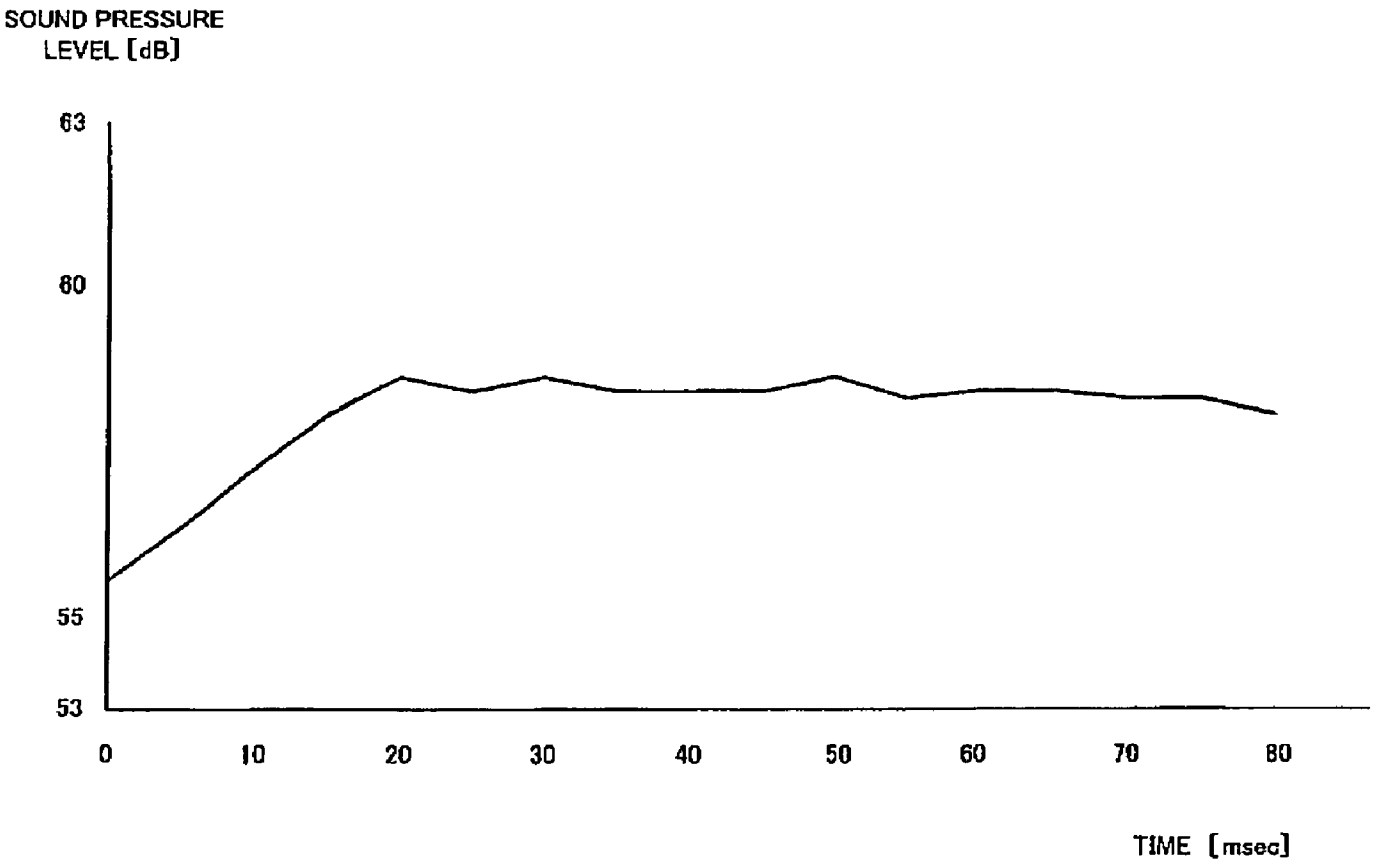
FIG. 17 shows an example of a reverberation characteristic for all frequency bands obtained by measurement.

FIG. 17 shows a calculation example of the reverberation characteristics for all frequency bands in the sound space subjected to the measurement, calculated on the basis of the total power for each block period thus obtained. In the present embodiment, 16 total powers are obtained in the period 0 ms to 80 ms, and the reverberation characteristic is independently obtained in the short time width being one block period (i.e., 5 ms).

In the above-mentioned embodiment, the reverberation characteristics for all frequency bands of about 80 ms are measured by using the measurement sound data 240 including 4096 samples (about 80 ms). However, by using the measurement sound data whose length and resolution (i.e., a number of division=16) are identical to those of the above-mentioned measurement sound data 240, much longer sound characteristic can be measured.

Now, the description will now be given of the example of measuring the reverberation characteristic of total 8192 samples (about 160 ms) by using the identical measurement sound data 240. In order to measure the reverberation characteristic having the length twice longer than the measurement sound data 240, the measurement sound data 240 including 4096 samples is divided into the short-time block sound data pn0 to pn15, and they are outputted twice (i.e., for two cycles) to perform the measurement. Namely, at each measurement, the block sound data pn0 to pn15 are outputted for two cycles during 32 block periods from T0 to T31, and the measurement is performed. FIG. 18 shows the output pattern of the block sound data pn in this case, and FIG. 19 shows an example of the obtained sound powers. As understood from FIG. 18 and FIG. 19, for example, at the first measurement, the output of the first cycle is performed in the order of the block sound data pn0 to pn15, and identically the output of the second cycle is performed in the order of the block sound data pn0 to pn15 afterward. Thereby, the detected sound data including 8192 samples (about 160 ms) can be obtained. Similarly, at the second to sixteenth measurement, the block sound data pn are outputted for two cycles. Thus, the reverberation characteristic of 8192 samples (about 160 ms) can be obtained by calculating the total powers rv0 to rv31 for each of the block periods T0 to T31.

By the method, the length of the reverberation characteristic to be obtained is double. However, since the identical measurement sound data is repeatedly outputted without making the used measurement sound data itself longer, increasing a number of measurements is unnecessary. For example, if the method of the present embodiment is executed by using the measurement sound data including 8192 samples in order to measure the reverberation characteristics including 8192 samples, it is necessary to perform the measurement for 32 times by using the block sound data pn0 to pn31 of 32 blocks (i.e., the number of measurement in FIG. 18 and FIG. 19 increases to 32 times). On the contrary, if the measurement is performed for two cycles by using the measurement sound data including 4096 samples, the reverberation characteristic of the double length can be measured with the number of measurement maintained at 16 times.

Figure 20:
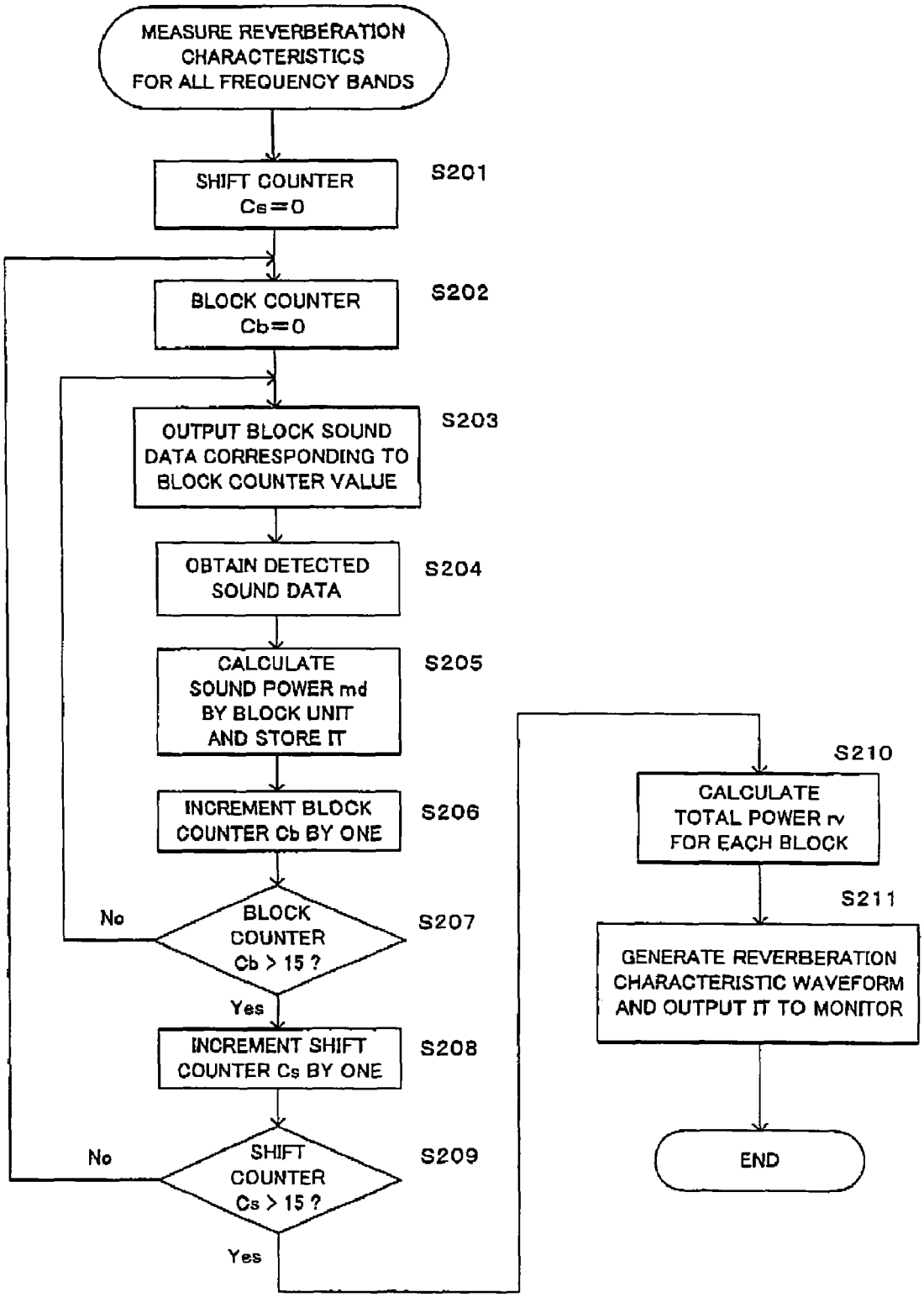
FIG. 20 is a flow chart of a reverberation characteristic measurement process for all frequency bands.

Next, the description will be given of the above-mentioned measurement process of the reverberation characteristics for all frequency bands (i.e., full frequency band). FIG. 20 is a flow chart of the measurement process of the reverberation characteristic for all frequency bands. Basically, the signal processing unit 202 in the sound characteristic measuring device 200 shown in FIG. 13 executes the process explained below by controlling the speaker 216, the microphone 218 and the like.

First, the signal processing unit 202 sets the value of a shift counter Cs to "0" (step S201). The shift counter Cs indicates the number of measurement, performed with shifting the block sound data pn0 to pn15. In the present embodiment, as shown in FIG. 15 and FIG. 16, since the measurement is performed 16 times in total, the value of the shift counter Cs finally increases up to "16". The first measurement is performed with the value of the shift counter Cs set to "0".

Next, the signal processing unit 202 sets the value of a block counter Cb to "0" (step S202). The block counter Cb designates the block sound data pn used for the measurement. With the value of the block counter Cb set to "0", the measurement by using the block sound data pn0 is performed.

Next, the signal processing unit 202 outputs, from the speaker 216, the block sound data pn designated by the block counter Cb at present (step S203). Since the block counter Cb is set to "0" in step S202, first the block sound data pn0 is reproduced and outputted to the sound space 260 as the measurement sound. Then, the signal processing unit 202 obtains the detected sound data 214 collected from the sound space 260 by the microphone 218 and then A/D-converted (step S204). The signal processing unit 202 calculates the sound power md (md0 at this time) of the block period by the above-mentioned method by using the equation (11), and stores it in the internal memory 206 (step S205). Thus, the measurement of the first block period T0 at the first measurement is completed.

Next, the signal processing unit 202 increments the block counter Cb by one, and determines whether the value of the block counter Cb is larger than "15" or not (step S207). When the value of the block counter Cb is equal to or smaller than 15, the process returns to step S203 for performing the measurement in the next block period. Then, the measurement process corresponding to the next block period is executed (steps S203 to S206).

In that method, when the measurement by using all the block period, i.e., all the block sound data pn included in the measurement sound data 240 (16 block sound data pn0 to pn15 in the present embodiment), is completed, the value of the block counter Cb becomes 16 (step S207; Yes). Namely, the first measurement is completed, and the signal processing unit 202 increments the shift counter Cs by one (step S208). Thereby, the second measurement is started.

Afterward, identically to the first measurement, the signal processing unit 202 outputs the block sound data pn corresponding to the value of the block counter Cb (step S203), and obtains the detected sound data (step S204). Further, the signal processing unit 202 calculates the sound power md for each block period (step S205), and increments the block counter Cb by one (step S206). However, at the second measurement, as shown in FIG. 15, the block sound data pn reproduced first is shifted by one, and 16 block sound data pn are reproduced in the order of the block sound data pn1 to pn15 and then pn0. When the second measurement is completed (step S207; Yes), the signal processing unit 202 increments the shift counter Cs by one (step S208), and the third measurement is performed in the same manner. As described above, all of 16 block sound data pn0 to pn15 are reproduced at the respective measurement, but the block sound data reproduced first is shifted by one at each measurement, as shown in FIG. 15.

When the shift counter Cs becomes larger than "15", i.e., when the sixteenth measurement is completed (step S209; Yes), the values of all 16 sound powers md corresponding to 16 block periods are stored in the internal memory 206 in the signal processing unit 202, as shown in FIG. 16. Thus, in accordance with the above-mentioned equation (12), the signal processing unit 202 calculates the total power rv for each block, for each block period, i.e., by totaling the reverberation powers md in the column direction in FIG. 16 (step S210). Subsequently, the signal processing unit 202 generates the reverberation characteristic waveform shown in FIG. 17 on the basis of the total power values thus obtained, and displays it on the monitor 205 (step S211). Thereby, the user can know the reverberation characteristic of the sound space 260.

It is noted that the above explanation is directed to an example of the process in a case that the reverberation characteristic of 4096 samples (about 80 ms) is measured, as shown in FIG. 15 and FIG. 16. On the other hand, when the reverberation characteristic of 8192 samples (about 160 ms) is measured as shown in FIG. 18 and FIG. 19, identically, it is determined whether the shift counter Cs is larger than "15" or not in step S209 in FIG. 20. However, it is determined whether the block counter Cb is larger than "31" or not in step S207. Namely, at each measurement, the block sound data of 32 blocks are measured.

Next, the description will be given of the measurement of the reverberation characteristic for each frequency according to the present embodiment. In the above-mentioned explanation, the reverberation characteristics for all frequency bands of the sound space 260 are measured by using the measurement sound data 240. However, in the present embodiment, it is further possible to obtain the reverberation characteristic for each frequency. A method thereof will be explained below.

Figure 22:
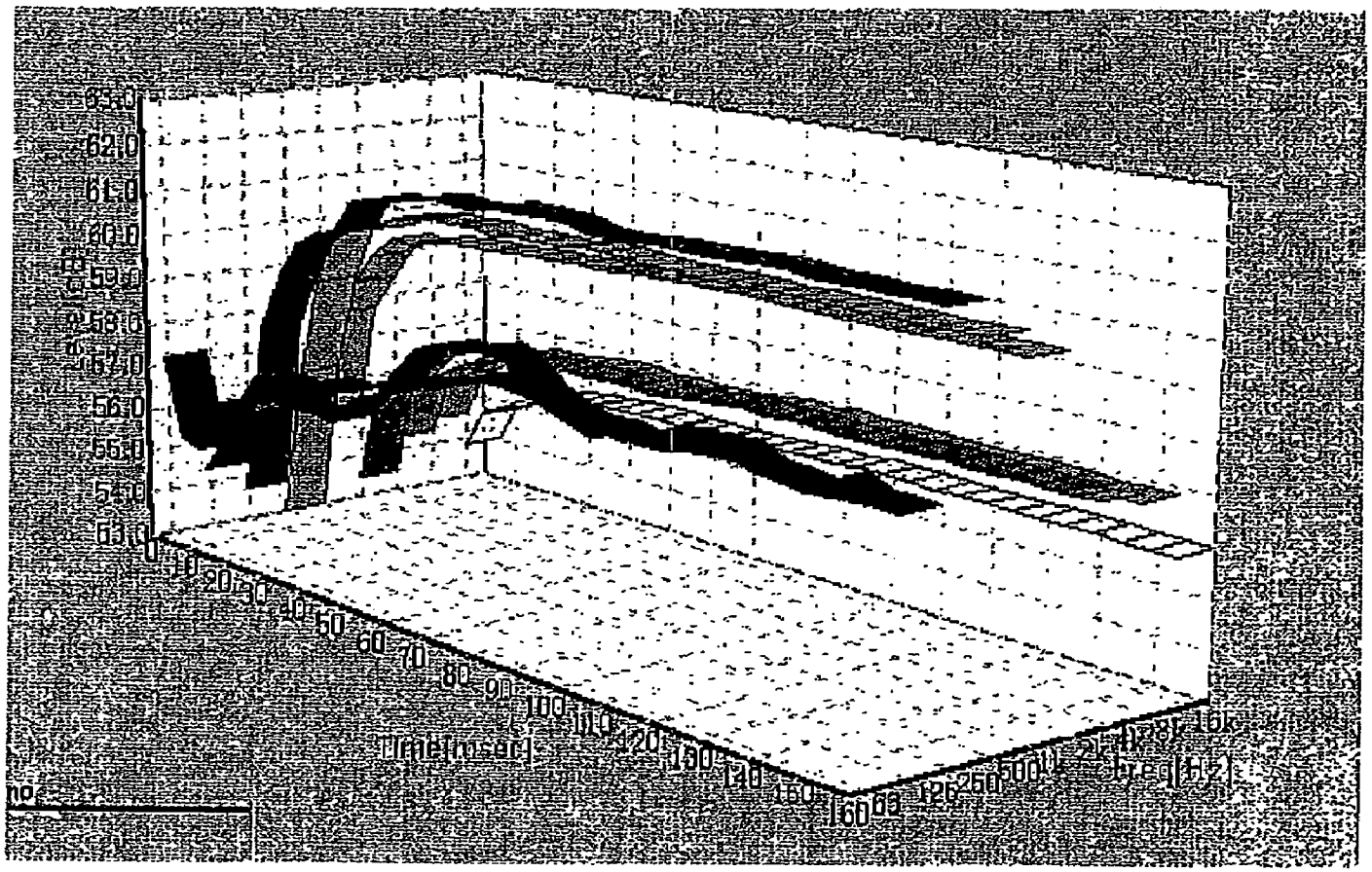
FIG. 22 shows an example of a reverberation characteristic for each frequency obtained by measurement.

The measurement sound data 240 is outputted, and the signal processing unit 202 frequency-analyzes the detected sound data 214 obtained via the microphone 218. Thereby, basically, the reverberation characteristic for each frequency can be obtained. The measurement of the reverberation characteristic for each frequency is identical to the measurement of the reverberation characteristics for all frequency bands, in that the measurement sound data 240 is divided into the plural block sound data pn and the measurement is performed for plural times with the output order of the sound data pn shifted. Concretely, by the one measurement shown in FIG. 15, the signal processing unit 202 can obtain the detected sound data 214 including 4096 samples. Therefore, the signal processing unit 202 calculates the reverberation power md by using the detected sound data including 4096 samples obtained at the one measurement, and performs filtering by using the frequency analyzing filter 207. Subsequently, the signal processing unit 202 generates the reverberation power md for each necessary frequency band, and stores it in the internal memory 206. For example, when the full frequency band is divided into nine frequency bands and the reverberation characteristics are measured, the signal processing unit 202 generates the reverberation powers md of the nine frequency bands by filtering. Afterward, the signal processing unit 202 totals the reverberation power md for each block period for each frequency band, and calculates the total power rv. In other word, there can be obtained the sound power data of the necessary number of frequency bands, which are shown in FIG. 16. The signal processing unit 202 then generates the three-dimensional reverberation characteristic shown in FIG. 22 for each frequency by using the total power data of the necessary number of frequency bands, and displays it on the monitor 205. In the example of FIG. 22, the full frequency band is divided into nine frequency bands, and the value on the frequency axis indicates a center frequency for each of the nine frequency bands. Like this, the reverberation characteristic can be measured for each frequency. In that case, the reverberation characteristic for each frequency is also obtained as the unit of the block period, i.e., as the reverberation characteristic of the short-time (about 5 ms).

FIG. 21 shows a flow chart of the measurement process of the reverberation characteristic for each frequency. The process is also basically executed by the signal processing unit 202, and the basic process is identical to the measurement process of the reverberation characteristic for the full frequency band, which is shown in FIG. 20.

Figure 21A:
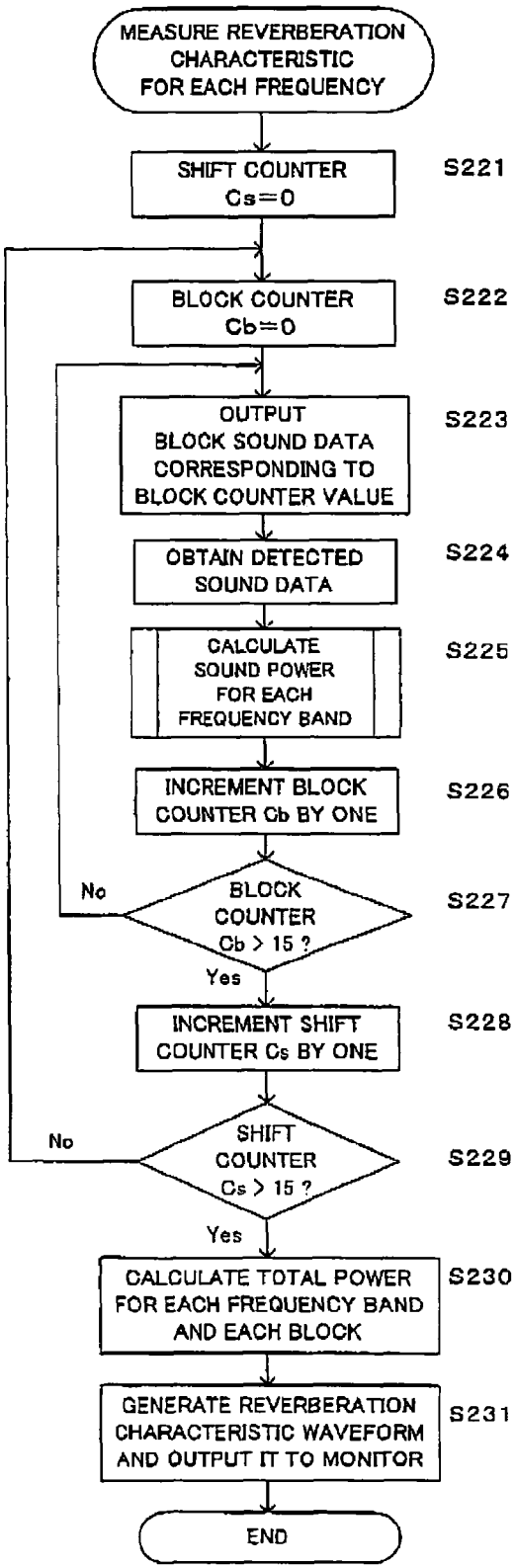
FIGS. 21A and 21B are flow charts of a reverberation characteristic measurement process for each frequency.

First, as shown in FIG. 21A, the signal processing unit 202 sets the shift counter Cs to "0" (step S221), and next sets the block counter Cb to "0" (step S222). Then, the signal processing unit 202 outputs the measurement sound data corresponding to the block counter value, i.e., the block sound data pn (step S223), and obtains the correspondent detected sound data (step S224). Moreover, the signal processing unit 202 executes a calculation process of the sound power for each frequency band (step S225).

Figure 21B:
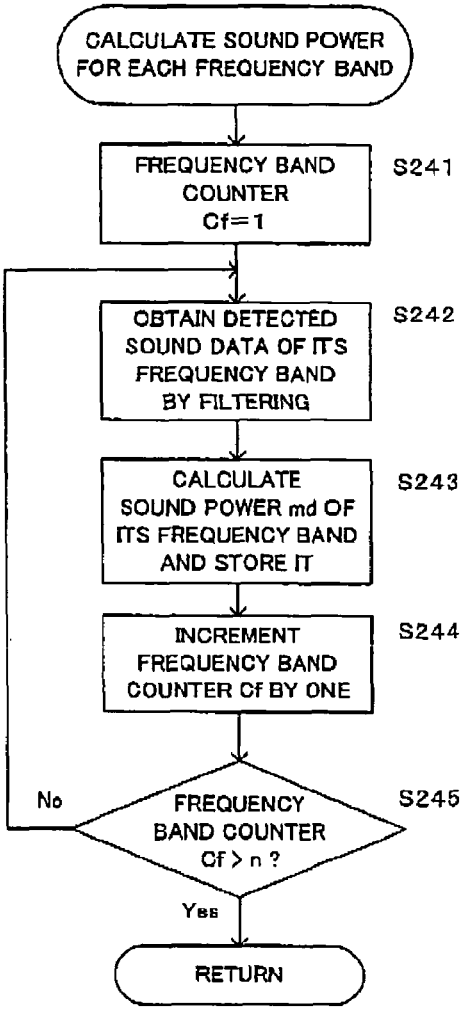

FIG. 21B shows the calculation process of the sound power for each frequency band. First, the signal processing unit 202 sets a frequency band counter Cf to "1" (step S241). The frequency band counter Cf designates the frequency band subjected to the measurement of the reverberation characteristic for each frequency. In the example, it is assumed that a number of frequency bands subjected to the measurement is "n". The signal processing unit 202 filters the detected sound data by using the frequency analyzing filter 207, and obtains the detected data of the frequency band corresponding to the frequency band counter Cf (step S242). Then, the signal processing unit 202 calculates the sound power md of the frequency band, and stores it (step S243).

Next, the signal processing unit 202 increments the frequency band counter Cf by one, and determines whether or not the frequency band counter Cf is larger than the frequency band number n subjected to the measurement (step S245). Until the frequency band counter Cf becomes larger than the frequency band number n (step S245; No), the signal processing unit 202 executes the identical process for the next frequency band (steps S242 to S243), and calculates the sound power md for the frequency band. When the frequency band counter Cf becomes larger than the frequency band number n (step S245; Yes), the process returns to the main routine shown in FIG. 21A.

In this way, the signal processing unit 202 calculates the sound power md for each block period, and stores it for each frequency band (step S225). Then, the signal processing unit 202 increments the value of the block counter by one (step S226) and repeats the process for the plural times, corresponding to the number of block periods (16 times in the present embodiment), until the block counter Cb becomes larger than 15, thereby to complete one measurement (step S227).

When one measurement is completed, the signal processing unit 202 increments the shift counter Cs by one, and performs the next measurement (step 5228). When the shift counter Cs becomes larger than 15, i.e., when all 16 measurements are completed (step S229; Yes), the signal processing unit 202 calculates the sound power md for each number of measurement and for each block period, as shown in FIG. 15, for each frequency band, and further calculates the total power rv (step S230). Subsequently, for each frequency band, the signal processing unit 202 generates the reverberation characteristic waveform for each frequency, indicating the total power for each block period, i.e., the three-dimensional waveform, such as the waveform shown in FIG. 2, and displays it on the monitor 205 (step S231) Thereby, the reverberation characteristic for each frequency can be obtained. In this way, in the present embodiment, as for the reverberation characteristic for each frequency, it becomes possible to measure the characteristic by the unit of the block period, i.e., in the short time width (about 5 ms).

As shown in FIG. 15 and FIG. 16, in the above-mentioned example, by shifting the block sound data pn reproduced first by one, the block sound data pn is reproduced for all the patterns of the reproduction order. However, if the block sound data pn is reproduced for all the patterns of the reproduction order, it is unnecessary to shift the block sound data pn reproduced first by one. Namely, it does not matter that the order of performing the pattern of the first to sixteenth reproduction order shown in FIG. 15 is different. For example, it does not matter that the block sound data pn is reproduced in the order from the pattern of the sixteenth reproduction order, in the lowermost column in FIG. 15, to the pattern of the first reproduction order, in the uppermost column.

[Modification]

In the above-mentioned embodiment, the signal process according to the present invention is realized by the signal processing circuit. Instead, if the identical signal process is designed as a program to be executed on a computer, the signal process can be realized on the computer. In that case, the program is supplied by a recording medium, such as a CD-ROM and a DVD, or by communication by using a network and the like. As the computer, a personal computer and the like can be used, and an audio interface corresponding to plural channels, plural speakers and microphones and the like a reconnected to the computer as peripheral devices. By executing the above-mentioned program on the personal computer, the measurement signal is generated by using the sound source provided inside or outside the personal computer, and is outputted via the audio interface and the speaker to be collected by using the microphone. Thereby, the above-mentioned sound characteristic measuring device and automatic sound field correcting device can be realized by using the computer.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2003-389025 filed on Nov. 19, 2003 including the specification, claims, drawings and summary is incorporated herein by reference in its entirety.

What is claimed is:

1. An automatic sound field correcting device which executes a signal processing to an audio signal on a signal transmission path to output a processed audio signal to a correspondent speaker, comprising:

a frequency characteristics correcting unit which corrects a frequency characteristic of an audio signal on the signal transmission path;

a measurement signal supplying unit which supplies a measurement signal to the signal transmission path;

a measurement sound output unit which outputs a measurement sound corresponding to the measurement signal from the speaker to a sound space;

a detecting unit which outputs the measurement signal sound outputted from the speaker as a detecting signal; and a correction amount determining unit which determines a correction amount used for a correction of the frequency characteristic by the frequency characteristics correcting unit and supplies the correction amount to the frequency characteristics correcting unit, wherein the correction amount determining unit determines the correction amount based on the detecting signal at a first correction of the frequency characteristic, and determines the correction amount based on the detecting signal or an output signal of the frequency characteristics correcting unit at and after a second correction of the frequency characteristic.

2. The automatic sound field correcting device according to claim 1, wherein the correction amount determining unit determines the correction amount based on the output signal of the frequency characteristics correcting unit at and after the second correction.

3. The automatic sound field correcting device according to claim 1, wherein the correction amount determining unit determines the correction amount based on the detecting signal at least once at and after the second correction.

4. The automatic sound field correcting device according to claim 1, wherein the correction amount determining unit determines the correction amount based on the detecting signal at least at the last correction of the second and subsequent correction.

5. The automatic sound field correcting device according to claim 1, wherein the detecting unit outputs no detecting signal at the correction at which the correction amount determining unit determines the correction amount based on the output signal of the frequency characteristics correcting unit.

6. The automatic sound field correcting device according to claim 1, wherein the measurement sound output unit outputs no measurement sound at the correction at which the correction amount determining unit determines the correction amount based on the output signal of the frequency characteristics correcting unit.

7. The automatic sound field correcting device according to claim 1, wherein the measurement sound output unit outputs the measurement sound at all the corrections of the frequency characteristic.

8. The automatic sound field correcting device according to claim 1, wherein the measurement sound output unit comprises:

a block sound data generating unit which divides the measurement signal of a predetermined time period into a plurality of block periods and generates a plurality of block sound data; and a reproduction processing unit which outputs the measurement sound by executing a reproducing process of reproducing the plurality of block sound data in accordance with an order of forming the measurement signal for a reproduction order pattern identical to the measurement sound data and for all reproduction order patterns obtained by shifting the block sound data reproduced first one by one, wherein the correction amount determining unit operates the detecting signal corresponding to the block sound data reproduced in an identical reproduction order during each reproducing process and determines the frequency characteristic to determine the correction amount based on the frequency characteristic, and wherein the reproduction processing unit executes the reproducing process for only the reproduction order pattern identical to the measurement signal at the correction at which the correction amount determining unit determines the correction amount based on the output signal of the frequency characteristics correcting unit.

9. A computer program product in a computer-readable medium, the computer program product making a computer function as an automatic sound field correcting device which executes a signal processing to an audio signal on a signal transmission path to output a processed audio signal to a correspondent speaker, the automatic sound field correcting device comprising:

a frequency characteristics correcting unit which corrects a frequency characteristic of the audio signal on each signal transmission path;

a measurement signal supplying unit which supplies a measurement signal to each signal transmission path;

a measurement sound output unit which outputs a measurement sound corresponding to the measurement signal from the speaker to a sound space;

a detecting unit which outputs the measurement signal sound outputted from the speaker as a detecting signal; and a correction amount determining unit which determines a correction amount used for a correction of the frequency characteristic by the frequency characteristics correcting unit and supplies the correction amount to the frequency characteristics correcting unit, and wherein the correction amount determining unit determines the correction amount based on the detecting signal at a first correction of the frequency characteristic, and determines the correction amount based on the detecting signal or an output signal of the frequency characteristics correcting unit at and after a second correction of the frequency characteristic.

10. An automatic sound field correcting method which executes a signal processing to an audio signal on a signal transmission path to output a processed audio signal to a correspondent speaker, comprising:

a measurement signal supplying process which supplies a measurement signal to the signal transmission path;

a measurement sound outputting process which outputs a measurement sound corresponding to the measurement signal from the speaker to a sound space;

a detecting process which outputs the measurement signal sound outputted from the speaker as a detecting signal;

a correction amount determining process which determines a correction amount used for a correction of a frequency characteristic; and a frequency characteristics correction process which corrects a frequency characteristic of an audio signal on the signal transmission path by using the correction amount determined in the correction amount determining process, wherein the correction amount determining process determines the correction amount based on the detecting signal at a first correction of the frequency characteristic, and determines the correction amount based on the detecting signal or an output signal by the frequency characteristics correction process at and after a second correction of the frequency characteristic.

* * * * *